US010380957B2

(12) United States Patent
Mizusako et al.

(10) Patent No.: US 10,380,957 B2
(45) Date of Patent: Aug. 13, 2019

(54) ELECTROOPTIC DEVICE, ELECTRONIC DEVICE, AND DRIVING METHOD

(71) Applicant: SEIKO EPSON CORPORATION, Tokyo (JP)

(72) Inventors: Kazuhisa Mizusako, Shiojiri (JP); Hiroyuki Hosaka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 23 days.

(21) Appl. No.: 15/797,755

(22) Filed: Oct. 30, 2017

(65) Prior Publication Data

US 2018/0122313 A1 May 3, 2018

(30) Foreign Application Priority Data

Nov. 1, 2016 (JP) ..... 2016-214067

(51) Int. Cl.
*G09G 3/36* (2006.01)

(52) U.S. Cl.
CPC ..... *G09G 3/3607* (2013.01); *G09G 3/3611* (2013.01); *G09G 3/3614* (2013.01); *G09G 3/3685* (2013.01); *G09G 2320/0233* (2013.01); *G09G 2320/0271* (2013.01); *G09G 2370/08* (2013.01)

(58) Field of Classification Search
CPC .. G09G 3/3607; G09G 3/3611; G09G 3/3614; G09G 3/3685
USPC ..... 345/55, 90, 94, 694; 370/535; 382/275
See application file for complete search history.

(56) References Cited

U.S. PATENT DOCUMENTS 4,760,270 A * 7/1988 Miller ..... G01N 21/88 250/559.39
6,445,720 B1 * 9/2002 Mukojima ..... H04J 4/0221 370/535
7,719,503 B2 * 5/2010 Hosihara ..... G09G 3/3614 345/100
2002/0041263 A1 * 4/2002 Aoki ..... G09G 3/3614 345/55
2003/0020702 A1 * 1/2003 Matsuyama ..... G09G 3/367 345/204

(Continued)

FOREIGN PATENT DOCUMENTS

JP H05-216430 A 8/1993
JP 2001-100237 A 4/2001

(Continued)

*Primary Examiner* — Prabodh M Dharia
(74) *Attorney, Agent, or Firm* — Oliff PLC

(57) ABSTRACT

An electrooptic device includes a plurality of first pixels, a plurality of second pixels, a first supplying section that supplies a first data signal to the first pixels and drives the first pixels, a second supplying section that supplies a second data signal to the second pixels and drives the second pixels, and a controller that supplies a third data signal to the first supplying section and supplies a fourth data signal to the second supplying section. The first supplying section generates the first data signal based on the third data signal. The second supplying section generates the second data signal based on the fourth data signal. The controller individually corrects a fifth data signal serving as a source of the third data signal and a sixth data signal serving as a source of the fourth data signal and generates the third data signal and the fourth data signal.

13 Claims, 14 Drawing Sheets

(56) References Cited

U.S. PATENT DOCUMENTS

| | | | | |
|---|---|---|---|---|
| 2003/0030608 | A1* | 2/2003 | Kurumisawa | G09G 3/3625 345/87 |
| 2006/0192699 | A1* | 8/2006 | Azami | G09G 3/3688 341/100 |
| 2007/0057887 | A1* | 3/2007 | Itakura | G09G 3/3655 345/90 |
| 2007/0146281 | A1* | 6/2007 | Hosihara | G09G 3/3614 345/96 |
| 2010/0014874 | A1* | 1/2010 | Kawanishi | G02F 1/225 398/187 |
| 2014/0055432 | A1* | 2/2014 | Yamamoto | G09G 3/3233 345/205 |
| 2016/0300534 | A1* | 10/2016 | Kishi | G09G 3/3233 |

FOREIGN PATENT DOCUMENTS

| | | | |
|---|---|---|---|
| JP | 2001-195402 | A | 7/2001 |
| JP | 2009-03757 | A | 2/2009 |

* cited by examiner

FIG. 9

1-1

POSITIONS OF PIXELS (2048 PIXELS) IN HORIZONTAL DIRECTION (x DIRECTION)

GRADATION LEVELS (4096 GRADATIONS)

| | 0 | 511 | 1023 | 1535 | 2047 |
|---|---|---|---|---|---|
| 0 | P0 | P1 | P2 | P3 | P4 |
| 1023 | P5 | P6 | P7 | P8 | P9 |
| 2047 | P10 | P11 | P12 | P13 | P14 |
| 3071 | P15 | P16 | P17 | P18 | P19 |
| 4095 | P20 | P21 | P22 | P23 | P24 |

FIG. 10

1-2

POSITIONS OF PIXELS (2048 PIXELS) IN HORIZONTAL DIRECTION (x DIRECTION)

GRADATION LEVELS (4096 GRADATIONS)

| | 0 | 511 | 1023 | 1535 | 2047 |
|---|---|---|---|---|---|
| 0 | M0 | M1 | M2 | M3 | M4 |
| 1023 | M5 | M6 | M7 | M8 | M9 |
| 2047 | M10 | M11 | M12 | M13 | M14 |
| 3071 | M15 | M16 | M17 | M18 | M19 |
| 4095 | M20 | M21 | M22 | M23 | M24 |

ELECTROOPTIC DEVICE, ELECTRONIC DEVICE, AND DRIVING METHOD

BACKGROUND

1. Technical Field

The present invention relates to an electrooptic device, an electronic device, and a driving method.

2. Related Art

When a high-definition electrooptic device (for example, a liquid crystal display device) uses multiple driving circuits to output data signals, variations in the data signals may occur between the driving circuits due to individual differences or the like between the driving circuits. The variations may cause variation in luminance of the electrooptic device or the like.

JP-A-2001-100237 describes a technique for reducing variation in luminance by arranging driving circuits in such a manner that deviations between output of driving circuits located adjacent to each other are small.

In the technique described in JP-A-2001-100237, even if the driving circuits are arranged in such a manner that the deviations between the output of the driving circuits located adjacent to each other are small, a variation in data signals of the driving circuits does not change. Thus, in the technique described in JP-A-2001-100237, an image quality may be reduced due to the variation in the data signals.

SUMMARY

An advantage of some aspects of the invention is to suppress a reduction, caused by a variation in data signals, in an image quality.

In a first aspect of the invention, an electrooptic device includes a plurality of first pixels; a plurality of second pixels; a first supplying section that supplies a first data signal to the first pixels and drives the first pixels; a second supplying section that supplies a second data signal to the second pixels and drives the second pixels; and a controller that supplies a third data signal to the first supplying section and supplies a fourth data signal to the second supplying section. The first supplying section generates the first data signal based on the third data signal. The second supplying section generates the second data signal based on the fourth data signal. The controller individually corrects a fifth data signal serving as a source of the third data signal and a sixth data signal serving as a source of the fourth data signal and generates the third data signal and the fourth data signal.

According to the first aspect, the controller individually corrects the fifth data signal serving as the source of the third data signal and the sixth data signal serving as the source of the fourth data signal and generates the third data signal and the fourth data signal. Thus, a difference, corresponding to an individual difference or the like between the first supply circuit and the second supply circuit, between the first data signal and the second data signal can be added between the third data signal and the fourth data signal. Thus, the difference, corresponding to the individual difference or the like between the first supply circuit and the second supply circuit, between the first data signal and the second data signal can be offset or reduced by the difference between the third data signal and the fourth data signal. As a result, a reduction, caused by a variation in the first data signal and the second data signal, in an image quality can be suppressed.

In the first aspect of the invention, it is preferable that the electrooptic device further include a storage section that stores a first correction amount and a second correction amount and the controller use the first correction amount to correct the fifth data signal and use the second correction amount to correct the sixth data signal.

In this case, the third data signal is generated by correcting the fifth data signal using the first correction amount, and the fourth data signal is generated by correcting the sixth data signal using the second correction amount. Thus, by appropriately setting the first correction amount and the second correction amount, the difference, corresponding to the individual difference or the like between the first supply circuit and the second supply circuit, between the first data signal and the second data signal can be added between the third data signal and the fourth data signal. Thus, the difference, corresponding to the individual difference or the like between the first supply circuit and the second supply circuit, between the first data signal and the second data signal can be offset or reduced by the difference between the third data signal and the fourth data signal. As a result, a reduction, caused by a variation in the first data signal generated based on the third data signal and the second data signal generated based on the fourth data signal, in the image quality can be suppressed.

In the first aspect of the invention, it is preferable that the first correction amount include a first correction amount for positive polarity and a first correction amount for negative polarity, and the second correction amount include a second correction amount for positive polarity and a second correction amount for negative polarity. In addition, it is preferable that if the polarity of the first data signal is positive, the controller correct the fifth data signal using the first correction amount for positive polarity, and if the polarity of the first data signal is negative, the controller correct the fifth data signal using the first correction amount for negative polarity. In addition, it is preferable that if the polarity of the second data signal is positive, the controller correct the sixth data signal using the second correction amount for positive polarity, and if the polarity of the second data signal is negative, the controller correct the sixth data signal using the second correction amount for negative polarity.

In this case, a variation corresponding to the polarities of the first and second data signals can be reduced. Thus, a reduction, caused by the variation in the first and second data signals, in the image quality can be reduced.

In the first aspect of the invention, it is preferable that, based on whether the polarity of the first data signal is positive or negative, the controller switch whether a correction amount based on the first correction amount is added to or reduced from the fifth data signal, and it is preferable that, based on whether the polarity of the second data signal is positive or negative, the controller switch whether a correction amount based on the second correction amount is added to or reduced from the sixth data signal.

In this case, the addition or reduction of the correction amount based on the first correction amount and the addition or reduction of the correction amount based on the second correction amount can be easily set.

In the first aspect of the invention, it is preferable that the plurality of first pixels correspond to intersections of a plurality of scan lines with a plurality of first signal lines, and the plurality of second pixels correspond to intersections of the plurality of scan lines with a plurality of second signal lines. In addition, it is preferable that the first correction amount and the second correction amount correspond to positions in an extension direction of the scan lines. Furthermore, it is preferable that the controller correct the fifth data signal using the first correction amount corresponding to the positions, in the extension direction, of the first pixels to which the first data signal is supplied, and the controller correct the sixth data signal using the second correction amount corresponding to the positions, in the extension direction, of the second pixels to which the second data signal is supplied.

In this case, a difference caused by the individual difference or the like between the first supply circuit and the second supply circuit and corresponding to the correction related to the positions of the pixels can be added between the third data signal and the fourth data signal. Thus, the difference, corresponding to the individual difference or the like between the first supply circuit and the second supply circuit, between the first data signal and the second data signal can be offset or reduced by the difference between the third data signal and the fourth data signal. As a result, a reduction, caused by a variation in the first data signal generated based on the third data signal and the second data signal generated based on the fourth data signal, in the image quality can be suppressed.

In the first aspect of the invention, it is preferable that the storage section store a plurality of first positions in the extension direction, first correction amounts for the plurality of first positions, a plurality of second positions in the extension direction, second correction amounts for the plurality of second positions. In addition, it is preferable that if each of the positions, in the extension direction, of the first pixels to which the first data signal is supplied is different from the plurality of first positions, the controller calculate a correction amount for the fifth data signal by executing linear interpolation using the first correction amounts and use the calculated correction amount to correct the fifth data signal, and it is preferable that if each of the positions, in the extension direction, of the second pixels to which the second data signal is supplied is different from the plurality of second positions, the controller calculate a correction amount for the sixth data signal by executing linear interpolation using the second correction amounts and use the calculated correction amount to correct the sixth data signal.

In this case, even if the number of first correction amounts and the number of second correction amounts are small, a variation in the first and second data signals can be reduced.

In the first aspect of the invention, it is preferable that the first correction amount correspond to a gradation level of the fifth data signal, and the second correction amount correspond to a gradation level of the sixth data signal. In addition, it is preferable that the controller use the first correction amount to correct the fifth data signal, and the controller use the second correction amount to correct the sixth data signal.

In this case, the third data signal and the fourth data signal can be individually corrected based on the levels of the data signals, and a reduction, caused by a variation in the first data signal generated based on the third data signal and the second data signal generated based on the fourth data signal, in the image quality can be suppressed.

In the first aspect of the invention, it is preferable that the storage section store a plurality of first gradation levels, first correction amounts for the plurality of first gradation levels, a plurality of second gradation levels, and second correction amounts for the plurality of second gradation levels. In addition, it is preferable that if the gradation level of the fifth data signal is different from the plurality of first gradation levels, the controller calculate a correction amount for the fifth data signal by executing linear interpolation using the first correction amounts and use the calculated correction amount to correct the fifth data signal. Furthermore, it is preferable that if the gradation level of the sixth data signal is different from the plurality of second gradation levels, the controller calculate a correction amount for the sixth data signal by executing linear interpolation using the second correction amounts and use the calculated correction amount to correct the sixth data signal.

In this case, even if the number of first correction amounts and the number of second correction amounts are small, a variation in the first and second data signals can be reduced.

In a second aspect of the invention, an electronic device includes the aforementioned electrooptic device. The electrooptic device can suppress a reduction in the image quality.

In a third aspect of the invention, a method of driving an electrooptic device in which a first supplying section supplies a first data signal to a plurality of first pixels and drives the plurality of first pixels and a second supplying section supplies a second data signal to a plurality of second pixels and drives the plurality of second pixels includes causing a controller to individually correct a fifth data signal serving as a source of a third data signal and a sixth data signal serving as a source of a fourth data signal and generate the third data signal and the fourth data signal, causing the first supplying section to generate the first data signal based on the third data signal, and causing the second supplying section to generate the second data signal based on the fourth data signal.

According to the third aspect, the controller individually corrects the fifth data signal serving as the source of the third data signal and the sixth data signal serving as the source of the fourth data signal and generates the third data signal and the fourth data signal. Thus, a difference, corresponding to an individual difference or the like between the first supply circuit and the second supply circuit, between the first data signal and the second data signal can be added between the third data signal and the fourth data signal. Thus, the difference, corresponding to the individual difference or the like between the first supply circuit and the second supply circuit, between the first data signal and the second data signal can be offset or reduced by the difference between the third data signal and the fourth data signal. As a result, a reduction, caused by a variation in the first data signal and the second data signal, in an image quality can be suppressed.

BRIEF DESCRIPTION OF THE DRAWINGS

The invention will be described with reference to the accompanying drawings, wherein like numbers reference like elements.

FIG. 9 is a diagram schematically showing an LUT storing first correction amounts for positive polarity.

FIG. 10 is a diagram schematically showing an LUT storing first correction amounts for negative polarity.

DESCRIPTION OF EXEMPLARY EMBODIMENTS

Figure 1:
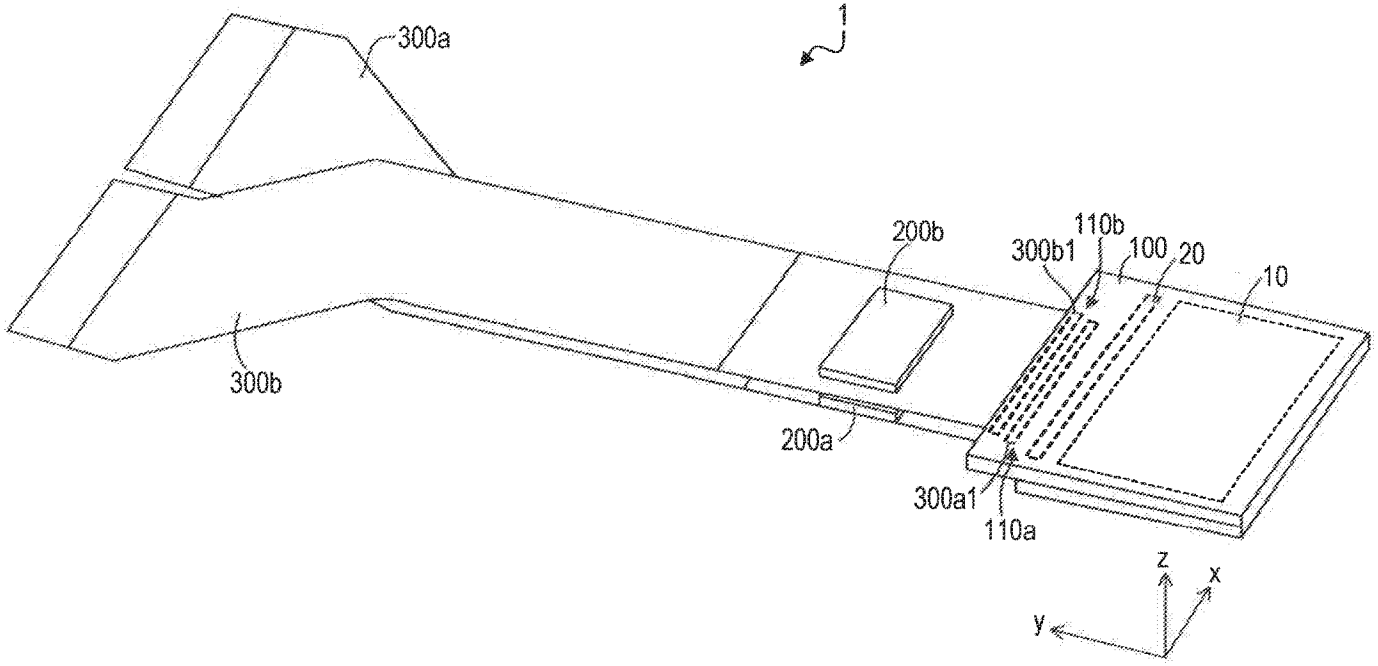
FIG. 1 is a diagram showing a configuration of a part of a signal transfer system of an electrooptic device according to a first embodiment of the invention.

Hereinafter, embodiments of the invention are described with reference to the accompanying drawings. Dimensions and reduced scales of sections shown in the drawings are different from actual sections. Since the following embodiments are specific examples of the invention, the embodiments include various technically preferable limitations. The scope of the invention, however, is not limited to the embodiments unless otherwise stated in the following description.

First Embodiment

Figure 2:
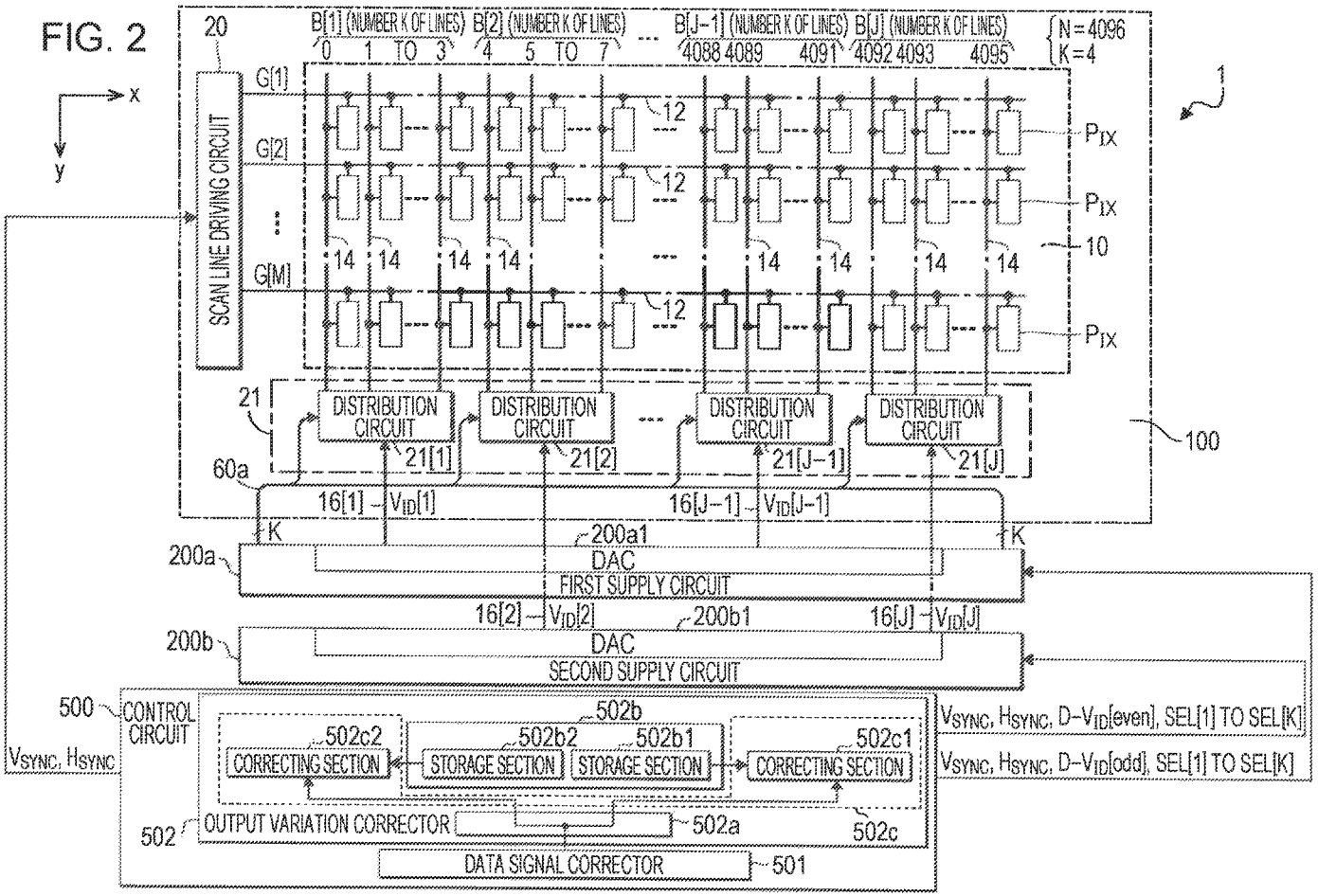
FIG. 2 is a diagram schematically showing a configuration of the electrooptic device.

FIG. 1 is a diagram showing a configuration of a part of a data transfer system of an electrooptic device 1 according to a first embodiment of the invention. FIG. 2 is a diagram schematically showing a configuration of the electrooptic device 1.

Overview of Electrooptic Device

The electrooptic device 1 includes an electrooptic panel 100, a first supply circuit 200*a*, a second supply circuit 200*b*, a flexible printed circuit board 300*a*, a flexible printed circuit board 300*b*, and a control circuit 500. Ends of the flexible printed circuit boards 300*a* and 300*b* are connected to a side of the electrooptic panel 100, while other ends of the flexible printed circuit boards 300*a* and 300*b* are connected to the control circuit 500. For example, the electrooptic device 1 has 2048 (2048 lines) pixel lines arranged side by side in a vertical direction (y direction) in the electrooptic panel 100, while 4096 pixels are arranged in each of the pixel lines in a horizontal direction (x direction). Thus, the electrooptic device 1 has twice as many pixels as full high-definition devices in the horizontal direction and twice as many pixels as full high-definition devices in the vertical direction. The number of pixels included in the electrooptic device 1 may be changed.

The electrooptic panel 100 displays gradations corresponding to any of red (R), green (G), and blue (B). An electrooptic device 1R having an electrooptic panel 100 provided for R and configured to display gradations corresponding to R, an electrooptic device 1G having an electrooptic panel 100 provided for G and configured to display gradations corresponding to G, and an electrooptic device 1B having an electrooptic panel 100 provided for B and configured to display gradations corresponding to B collaborate with each other to display a color image (refer to FIG. 18).

The control circuit 500 generates digital data signals $D\text{–}V_{ID}$ for driving the pixels of the electrooptic panel 100. The control circuit 500 supplies the digital data signals $D\text{–}V_{ID}$ to the first supply circuit 200*a* and the second supply circuit 200*b*. The control circuit 500 includes a data signal corrector 501 and an output variation corrector 502. The output variation corrector 502 includes a distributing section 502*a*, a storage section 502*b*, and a correcting section 502*c*. The storage section 502*b* includes a storage section 502*b*1 and a storage section 502*b*2. The correcting section 502*c* includes a correcting section 502*c*1 and a correcting section 502*c*2.

Each of the flexible printed circuit boards 300*a* and 300*b* includes a wiring (not shown in FIG. 1) for transferring a signal.

Ends (connection terminals 300*a*1 and 300*b*1) of the wirings of the flexible printed circuit boards 300*a* and 300*b* are connected to first and second input sections 110*a* and 110*b* of the electrooptic panel 100, respectively. Other ends of the wirings of the flexible printed circuit boards 300*a* and 300*b* are connected to a control substrate (not shown) on which the control circuit 500 is mounted. The first supply circuit 200*a* is electrically connected to the electrooptic panel 100 and the control circuit 500 via the wiring of the flexible printed circuit board 300*a*, while the second supply circuit 200*b* is electrically connected to the electrooptic panel 100 and the control circuit 500 via the wiring of the flexible printed circuit board 300*b*.

The first supply circuit 200*a* and the second supply circuit 200*b* are, for example, driving integrated circuits (driver ICs). For example, the first supply circuit 200*a* drives 2048 pixels that are a half of 4096 pixels included in each of the pixel lines of the electrooptic panel 100 and are arranged in the horizontal direction. The first supply circuit 200*a* and the second supply circuit 200*b* are mounted on the flexible printed circuit board 300*a* and the flexible printed circuit board 300*b* by a chip-on-film (COF) technique, respectively. The flexible printed circuit board 300*a* is stacked on the flexible printed circuit board 300*b*, while the first supply circuit 200*a* is stacked on the second supply circuit 200*b*. In the first embodiment, the flexible printed circuit board 300*a* and the flexible printed circuit board 300*b* are attached to the electrooptic panel 100 in such a manner that a part of the flexible printed circuit board 300*a* and a part of the flexible printed circuit board 300*b* overlap each other in a direction (z direction) perpendicular to a display surface of the electrooptic panel 100. The first supply circuit 200*a* and the second supply circuit 200*b* generate data signals $V_{ID}$ and drive the electrooptic panel 100 based on signals received from the control circuit 500. The data signals $V_{ID}$ have different waveforms corresponding to an image to be displayed and are analog signals. The first supply circuit 200*a* and the second supply circuit 200*b* receive the digital data signals $D\text{–}V_{ID}$ and various driving and control signals from the control circuit 500. The digital data signals $D\text{–}V_{ID}$ specify, for each time range, gradations of the pixels $P_{IX}$ included in the electrooptic panel 100. For example, the first supply circuit 200*a* and the second supply circuit 200*b* generate the analog data signals $V_{ID}$ based on the digital data signals $D\text{–}V_{ID}$ and use the generated data signals $V_{ID}$ to drive the pixels of the electrooptic panel 100. The first supply circuit 200*a* includes digital-to-analog converters (D/A converters (DACs)) 200*a*1 (multiple DACs 200*a*1 are collectively shown as one DAC in FIG. 2) for multiple data lines 16 for outputting data signals $V_{ID}$, while the second supply circuit 200*b* includes DACs 200*b*1 (multiple DACs 200*b*1 are collectively shown as one DAC in FIG. 2) for multiple data lines 16 for outputting data signals $V_{ID}$. The DACs 200*a*1 and 200*b*1 convert the digital data signals $D-V_{ID}$ to the analog data signals $V_{ID}$ and output the analog data signals $V_{ID}$.

When the data signals $V_{ID}$ generated by the first supply circuit 200*a* and the data signals $V_{ID}$ generated by the first supply circuit 200*b* are distinguished from each other, the data signals $V_{ID}$ generated by the first supply circuit 200*a* are referred to as data signals $V_{ID}$[odd], and the data signals $V_{ID}$ generated by the second supply circuit 200*b* are referred to as data signals $V_{ID}$[even]. In addition, when the digital data signal $D-V_{ID}$ received by the first supply circuit 200*a* and the digital data signal $D-V_{ID}$ received by the second supply circuit 200*b* are distinguished from each other, the digital data signal $D-V_{ID}$ received by the first supply circuit 200*a* is referred to as digital data signal $D-V_{ID}$[odd], and the digital data signal $D-V_{ID}$ received by the second supply circuit 200*b* is referred to as digital data signal $V_{ID}$[even]. Each of the data signals $V_{ID}$[odd] is an example of a first data signal. Each of the data signals $V_{ID}$[even] is an example of a second data signal. The digital data signal $D-V_{ID}$[odd] is an example of a third data signal. The digital data signal $D-V_{ID}$[even] is an example of a fourth data signal.

The electrooptic panel 100 includes a pixel section 10 having the plurality of pixels $P_{IX}$ arranged in a matrix, a distribution circuit group 21, a scan line driving circuit 20, a first input section 110*a*, and a second input section 110*b*.

The first input section 110*a* and the second input section 110*b* are input terminal groups. The first input section 110*a* receives various signals output from the first supply circuit 200*a* via the flexible printed circuit board 300*a*, for example. The second input section 110*b* receives various signals output from the second supply circuit 200*b* via the flexible printed circuit board 300*b*, for example. The electrooptic panel 100 is driven based on the various signals received by the first input section 110*a* and the various signals received by the second input section 110*b*.

In the pixel section 10, a number M (M is a natural number) of scan lines 12 extending from the scan line driving circuit 20 in a row direction (horizontal direction or x direction) and a number N (N is a natural number) of signal lines 14 extending from the distribution circuit group 21 in a column direction (vertical direction or y direction) are formed. In the first embodiment, M=2048 and N=4096. M is not limited to 2048 and may be changed and N is not limited to 4096 and may be changed. The number M of scan line 12 are an example of a plurality of scan lines. The number M of scan line 12 intersect with the number N of signal lines 14 via an insulating layer.

The multiple pixels $P_{IX}$ correspond to intersections of the scan lines 12 with the signal lines 14. Thus, the multiple pixels $P_{IX}$ are arranged in the matrix of a number M of rows arranged side by side in the vertical direction and a number N of columns arranged side by side in the horizontal direction. Pixels $P_{IX}$ display gradations corresponding to potentials of signal lines 14 upon the selection of a scan line 12.

An entire region of the pixel section 10 may be an effective display region. Alternatively, a part of an outer region included in the entire region of the pixel section 10 may be a non-display region. Scan lines 12, signal lines 14, and pixels $P_{IX}$ within the outer region of the pixel section 10 may be arranged as dummy scan lines 12, dummy signal lines 14, and dummy pixels $P_{IX}$.

The number N of signal lines 14 are classified into a number J of line groups (blocks B[j] (j is a natural number of $1 \leq j \leq J$, and J=N/K), each of which includes a number K of signal lines 14 (J and K are natural numbers). Specifically, the signal lines 14 are grouped into the line groups B. In the first embodiment, K=4. K is not limited to 4 and may be an integer of 2 or more. In the first embodiment, since N=4096 and K=4, the signal lines 14 are classified into 1024 line groups B.

The number J of line groups B[1] to B[J] correspond to a number J of data lines 16[1] to 16[J], respectively. A data signal $V_{ID}$[odd] or a data signal $V_{ID}$[even] is supplied to each of the data lines [1] to 16[J]. In the first embodiment, since J is an even number of 2 or more, and a number K of signal lines 14 included in each of the line groups B are adjacent to each other (continuous arrangement), odd-numbered line groups B[odd] among the number J of line groups B[j] and even-numbered ling groups B[even] among the number J of line groups B[j] are alternately arranged. The line groups B[odd] include the odd-numbered line groups B[1], B[3], . . . , and B[J−1]. The data signals $V_{ID}$[odd] including potentials specified for each time range and to be supplied to a number K of signal lines 14 belonging to each of the line groups B[odd] are output from the first supply circuit 200*a* via the first input section 110*a* to data lines 16[odd] corresponding to the line groups B[odd]. The line groups B[even] include the even-numbered line groups B[2], B[4], . . . , and B[J]. The data signals $V_{ID}$[even] including potentials specified for each time range and to be supplied to a number K of signal lines 14 belonging to each of the line groups B[even] are output from the second supply circuit 200*b* via the second input section 110*b* to data lines 16[even] corresponding to the line groups B[even].

The signal lines 14 belonging to the line groups B[odd] are an example of first signal lines, while the signal lines 14 belonging to the line groups B[even] are an example of second signal lines.

There is an individual difference or the like between the first supply circuit 200*a* and the second supply circuit 200*b*. Thus, for example, even if the common digital data signals $D-V_{ID}$ are input to the first and second supply circuits 200*a* and 200*b*, the data signals $V_{ID}$[odd] may be different from the data signals $V_{ID}$[even]. If the data signals $V_{ID}$[odd] are different from the data signals $V_{ID}$[even], variations in the data signals $V_{ID}$[odd] and the data signals $V_{ID}$[even] occur, and the image quality of the electrooptic panel 100 is reduced.

To avoid this, the control circuit 500 individually corrects a data signal serving as a source of the digital data signal D−VID[odd] and a digital signal serving as a source of the digital data signal D−VID[even] and generates the digital data signal D−VID[odd] and the digital data signal D−VID [even].

Specifically, the correcting section 502*c*1 uses a first correction amount stored in the storage section 502*b*1 to correct the data signal (fifth data signal) serving as the source of the digital data signal $D-V_{ID}$[odd] and generates the digital data signal $D-V_{ID}$[odd](third data signal). In addition, the correcting section 502*c*2 uses a second correction amount stored in the storage section 502*b*2 to correct the data signal (sixth data signal) serving as the source of the digital data signal $D-V_{ID}$[even] and generates the digital data signal $D-V_{ID}$[even] (fourth data signal).

By appropriately setting the first correction amount and the second correction amount, a difference corresponding to the individual difference or the like between the first and second supply circuits 200*a* and 200*b* can be added between the digital data signal $D-V_{ID}$[odd] and the digital data signal $D-V_{ID}$[even]. Thus, a difference, corresponding to the individual difference or the like between the first and second supply circuits 200*a* and 200*b*, between the data signals $V_{ID}$[odd] and the data signals $V_{ID}$[even] can be offset or reduced by the difference between the digital data signal $D-V_{ID}$[odd] and the digital data signal $D-V_{ID}$[even]. As a result, a reduction, caused by the difference between the data signals $V_{ID}$[odd] and the data signals $V_{ID}$[even], in the image quality can be suppressed.

Description of Operations and Signal Process of Electrooptic Device

Next, operations of the electrooptic device 1 and a correction process are described below.

Figure 3:
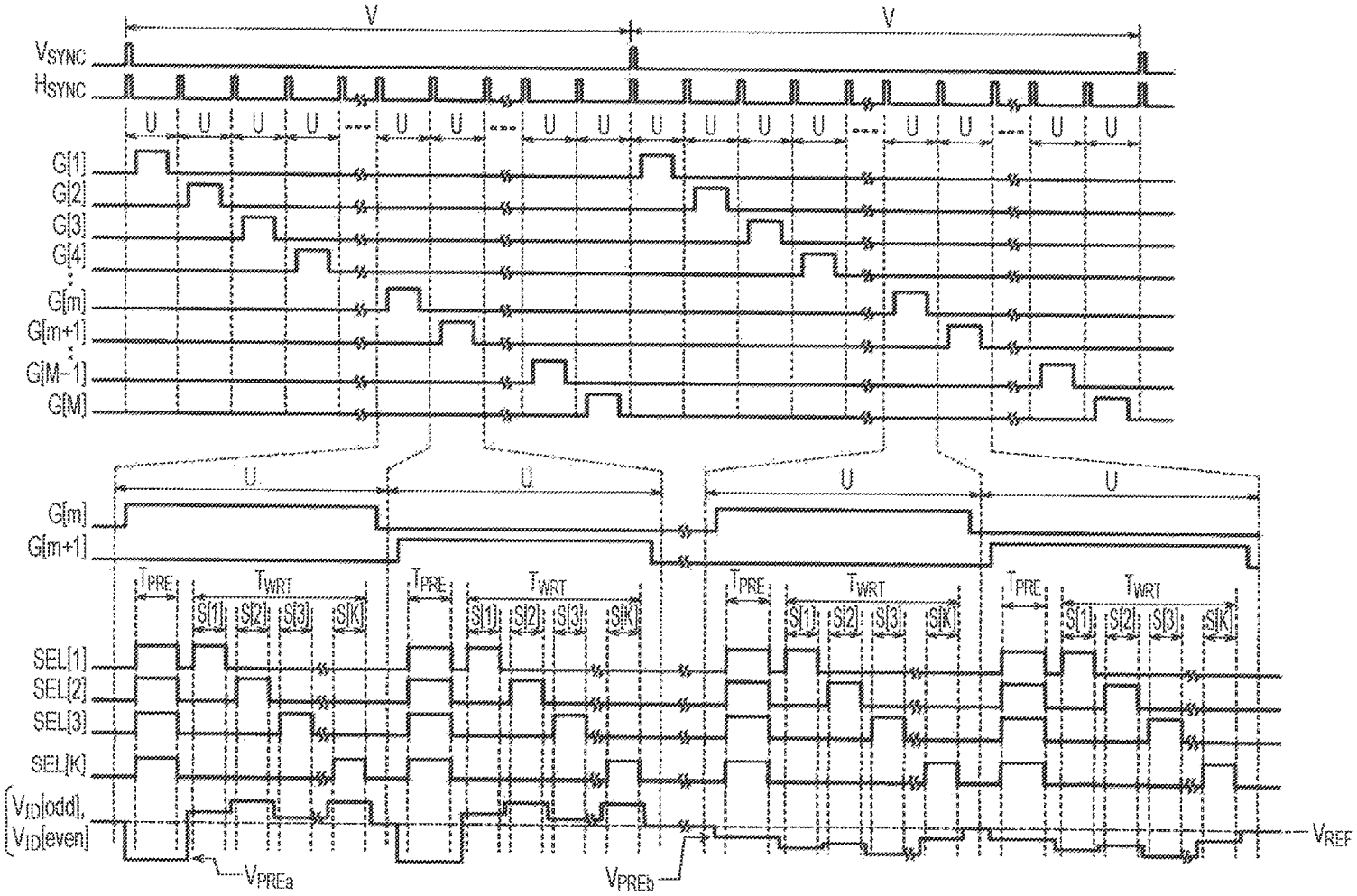
FIG. 3 is a diagram describing operations of the electrooptic device.

FIG. 3 is a diagram describing the operations of the electrooptic device 1. The control circuit 500 outputs a vertical synchronization signal $V_{SYNC}$ defining vertical scan time periods V and a horizontal synchronization signal $H_{SYNC}$ defining horizontal scan time periods U to the scan line driving circuit 20, the first supply circuit 200*a*, and the second supply circuit 200*b*. In addition, the control circuit 500 outputs, to the first and second supply circuits 200*a* and 200*b*, selection signals SEL[1] to SEL[K] and the digital data signals $D-V_{ID}$ that cause the polarities of the data signals $V_{ID}$ (potentials to be applied to liquid crystal elements 42 shown in FIG. 5) to be reversed in each of the vertical scan time periods V.

The scan line driving circuit 20 sequentially outputs scan signals G[1] to G[M] to the number M of scan lines 12 in unit time periods U and sequentially selects the number M of scan lines 12 based on the horizontal synchronization signal HSYNC. When the scan line driving circuit 20 selects a scan line 12 of an m-th row (m-th line), selection switches 44 (refer to FIG. 5) of a number N of pixels PIX of the m-th row transition to ON states.

The first supply circuit 200*a* and the second supply circuit 200*b* are synchronized with the selection signals SEL[1] to SEL[K] during a time period during which the scan line 12 of the m-th row is selected, and the first supply circuit 200*a* and the second supply circuit 200*b* supply potentials of the data signals $V_{ID}$ to the corresponding signal lines 14 via the distribution circuit group 21.

Figure 4:
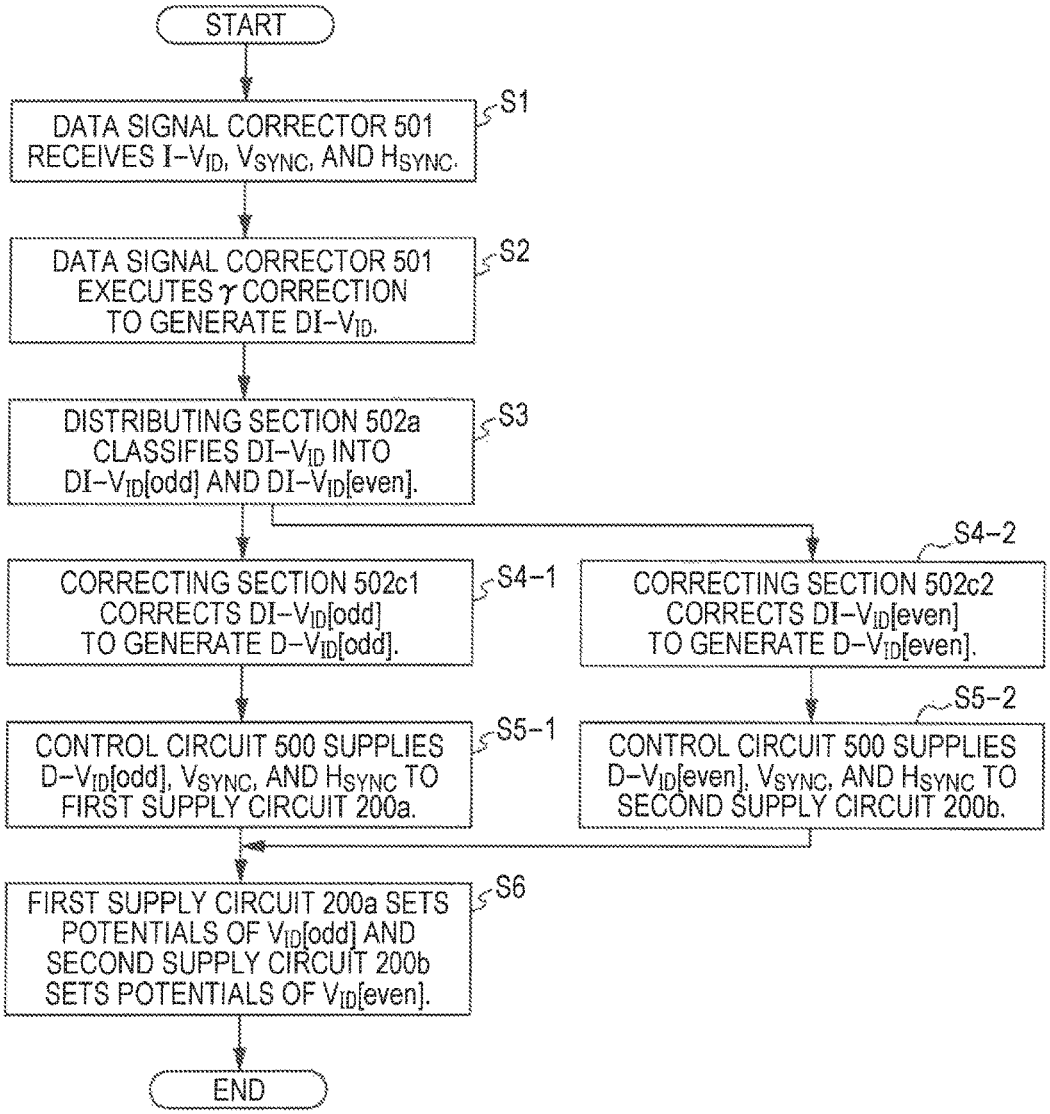
FIG. 4 is a diagram showing the flow of a signal process.

FIG. 4 is a diagram showing the flow of a signal process.

The data signal corrector 501 receives an image data signal $I-V_{ID}$, the vertical synchronization signal $V_{SYNC}$, and the horizontal synchronization signal $H_{SYNC}$ from a higher-level processing unit (in step S1) and executes γ correction on the image data signal $I-V_{ID}$ to generate an image data signal $DI-V_{ID}$ (in step S2).

The distributing section 502*a* divides the image data signal $DI-V_{ID}$ into a first distribution image data signal $DI-V_{ID}$[odd] and a second distribution image data signal $DI-V_{ID}$[even] (in step S3).

The correcting section 502*c*1 corrects the first distribution image data signal DI−VID[odd] to generate the digital data signal D−VID[odd] (in step S4-1). The correcting section 502*c*2 corrects the second distribution image data signal DI−VID[even] to generate the digital data signal D−VID [even] (in step S4-2).

In addition, the control circuit 500 supplies the digital data signal $D-V_{ID}$[odd], the vertical synchronization signal $V_{SYNC}$, and the horizontal synchronization signal $H_{SYNC}$ to the first supply circuit 200*a* (in step S5-1) and supplies the digital data signal $D-V_{ID}$[even], the vertical synchronization signal $V_{SYNC}$, and the horizontal synchronization signal $H_{SYNC}$ to the second supply circuit 200*b* (in step S5-2).

The first supply circuit 200*a* sets, for each time range, the potentials of the data signals $V_{ID}$[odd] to potentials corresponding to specified gradations of pixels $P_{IX}$ (refer to FIG. 5) corresponding to intersections of the scan line 12 of the m-th row with the signal lines 14 belonging to the line groups B[odd] (in step S6). The specified gradations of the pixels $P_{IX}$ are defined in the digital data signal $D-V_{ID}$[odd]. The first supply circuit 200*a* sequentially reverses, based on the digital data signal $D-V_{ID}$[odd], the polarities of the potentials of the data signals $V_{ID}$[odd] with respect to a standard potential $V_{REF}$ periodically (for example, in the vertical scan time periods V) in order to prevent so-called burn-in. The second supply circuit 200*b* sets, for each time range, the potentials of the data signals $V_{ID}$[even] to potentials corresponding to specified gradations of pixels $P_{IX}$ corresponding to intersections of the scan line 12 of the m-th row with the signal lines 14 belonging to the line groups B[even] (in step S6). The specified gradations of the pixels $P_{IX}$ are defined in the digital data signal $D-V_{ID}$[even]. In addition, the second supply circuit 200*b* sequentially reverses the polarities of the potentials of the data signals $V_{ID}$[even] with respect to the standard potential $V_{REF}$ periodically (for example, in the vertical scan time periods V).

In a selection time period S[k] (refer to FIG. 3, k is a natural number of $1 \leq k \leq K$) within the time period during which the scan line 12 of the m-to row is selected, k-th switches 40[k] (a number J of switches 40[k]), which are among a number K of switches 40[1] to 40[K] of each of distribution circuits 21[1] to 21[J] included in the distribution circuit group 21, transition to ON states based on a selection signal SEL[k] output from the first supply circuit 200*a*. Thus, the potentials of the data signals $V_{ID}$ are supplied to k-th signal lines 14 of the line groups B[j].

Specifically, during writing time periods $T_{WRT}$ included in the time periods U, the potentials of the data signals $V_{ID}$ are supplied to a number K of signal lines 14 included in each of the line groups B[j] or the number J of line groups B[1] to B[J] for each time range. Then, the potentials corresponding to the specified gradations are written in pixels $P_{IX}$ corresponding to intersections of the scan line 12 of the m-th row with the k-th signal lines 14 of the line groups B[j]. The selection signal SEL[k] output from the first supply circuit 200*a* is a timing signal based on the selection signal SEL[k] output from the control circuit 500.

Digital Data Signal $D-V_{ID}$[Odd] and Digital Data Signal $D-V_{ID}$[Even]

As described above, the control circuit 500 generates the digital data signal $D-V_{ID}$[odd] and the digital data signal $D-V_{ID}$[even] in order to reduce a variation in the data signals $V_{ID}$[odd] and the data signals $V_{ID}$[even]. Specifically, the data signal corrector 501 and the output variation corrector 502 that are included in the control circuit 500 operate as follows.

The data signal corrector 501 executes γ correction or the like on the image data signal $I-V_{ID}$ received from the higher-level processing unit to generate the image data signal $DI-V_{ID}$. The image data signal $DI-V_{ID}$ includes polarity information indicating a positive polarity or a negative polarity.

The output variation corrector 502 generates the digital data signal $D-V_{ID}$[odd] and the digital data signal $D-V_{ID}$ [even] based on the image data signal $DI-V_{ID}$. For example, the output variation corrector 502 divides the image data signal $DI-V_{ID}$ into the first distribution image data signal $DI-V_{ID}$[odd] and the second distribution image data signal $DI-V_{ID}$[even]. The first distribution image data signal $DI-V_{ID}$[odd] is an example of a fifth data signal. The second distribution image data signal $DI-V_{ID}$[even] is an example of a sixth data signal.

The output variation corrector 502 individually corrects the first distribution image data signal $DI-V_{ID}$[odd] and the second distribution image data signal $DI-V_{ID}$[even] to generate the digital data signal $D-V_{ID}$[odd] and the digital data signal $D-V_{ID}$[even].

Details of Electrooptic Device 1

Pixels $P_{IX}$

Figure 5:
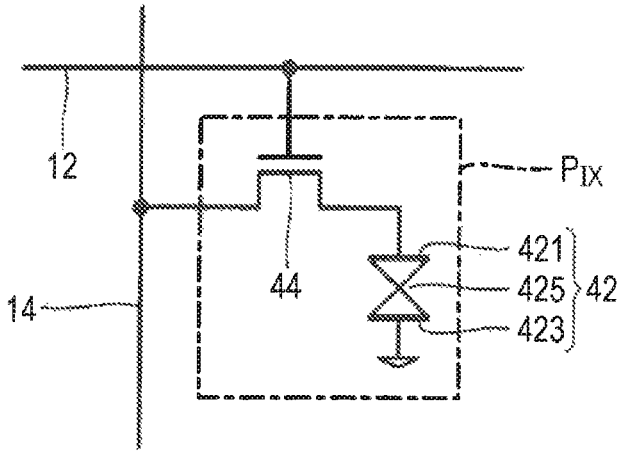
FIG. 5 is a diagram describing pixels of a pixel section.

FIG. 5 is a diagram describing the pixels $P_{IX}$ of the pixel section 10. Each of the pixels $P_{IX}$ includes a liquid crystal element 42 and a selection switch 44.

The liquid crystal elements 42 are an example of electrooptic elements. Each of the liquid crystal elements 42 includes a pixel electrode 421, a common electrode 423 arranged opposite to the pixel electrode 421, and liquid crystal 425 located between the pixel electrode 421 and the common electrode 423. The transmittance of the liquid crystal 425 changes based on a voltage applied between the pixel electrode 421 and the common electrode 423. As described above, the polarity of the voltage to be applied is periodically reversed in order to prevent so-called burn-in. In the following description, the voltage applied to the liquid crystal 42 when the potential of the pixel electrode 421 is higher than the potential of the common electrode 423 is referred to as "positive polarity", while the voltage applied to the liquid crystal 42 when the potential of the pixel electrode 421 is lower than the potential of the common electrode 423 is referred to as "negative polarity".

The selection switch 44 is composed of an N channel type thin film transistor having a gate connected to a scan line 12, for example. The selection switch 44 is located between the liquid crystal 42 (pixel electrode 421) and a signal line 14 and electrically controls a connection (conduction/non-conduction) between the liquid crystal 42 and the signal line 14. The pixel $P_{IX}$ (liquid crystal 42) displays a gradation corresponding to the potential of the signal line 14 when the selection switch 44 is controlled to be in an ON state. An illustration of auxiliary capacitance connected in parallel to the liquid crystal element 42 and the like is omitted. The configuration of each of the pixels $P_{IX}$ may be changed.

Scan Line Driving Circuit 20

The scan line driving circuit 20 sequentially outputs scan signals G[1] to G[M] to the number M of scan lines 12 based on the horizontal synchronization signal $H_{SYNC}$ in the unit time periods U and sequentially selects the number M of scan lines 12, as shown in FIG. 3. Each of the unit time periods U is set to a time length (horizontal scan time period (1 H)) of one cycle of the horizontal synchronization signal $H_{SYNC}$.

The scan line driving circuit 20 sets a scan signal G[m] to be supplied to a scan line 12 of an m-th row (m-th line) to a high level (potential indicating that the scan line 12 is selected) within an m-th unit time period U among a number M of unit time periods U included in each of the vertical scan time periods V. A time period during which a scan line 12 is selected is also referred to as line time period and nearly corresponds to a unit time period U in the first embodiment.

When the scan line driving circuit 20 selects the scan line 12 of the m-th row, selection switches 44 of a number N of pixels $P_{IX}$ of the m-th row transition to ON states.

Each of the unit time periods U includes a precharge time period $T_{PRE}$ and a writing time period $T_{WRT}$. In each of the unit time periods U, a precharge time period $T_{PRE}$ is before a writing time period $T_{WRT}$. In FIG. 3, a single precharge time period $T_{PRE}$ is before a writing time period $T_{WRT}$ in each of the unit time periods U. In each of the unit time periods U, however, multiple precharge time periods $T_{PRE}$ may be before a writing time period $T_{WRT}$. In each of the writing time periods $T_{WRT}$, the data signals $V_{ID}$ (potentials) are supplied to the signal lines 14. In each of the precharge time periods $T_{PRE}$, a predetermined precharge potential $V_{PRE}$ ($V_{PREa}$ or $V_{PREb}$) is supplied to each of the signal lines 14.

Distribution Circuit Group 21

The distribution circuit group 21 includes the number J of distribution circuits 21[1] to 21[J], as shown in FIG. 2. The distribution circuits 21[1] to 21[J] correspond to the line groups B[1] to B[J], respectively. As the distribution circuits 21[1] to 21[J], demultiplexers are used, for example.

Figure 6:
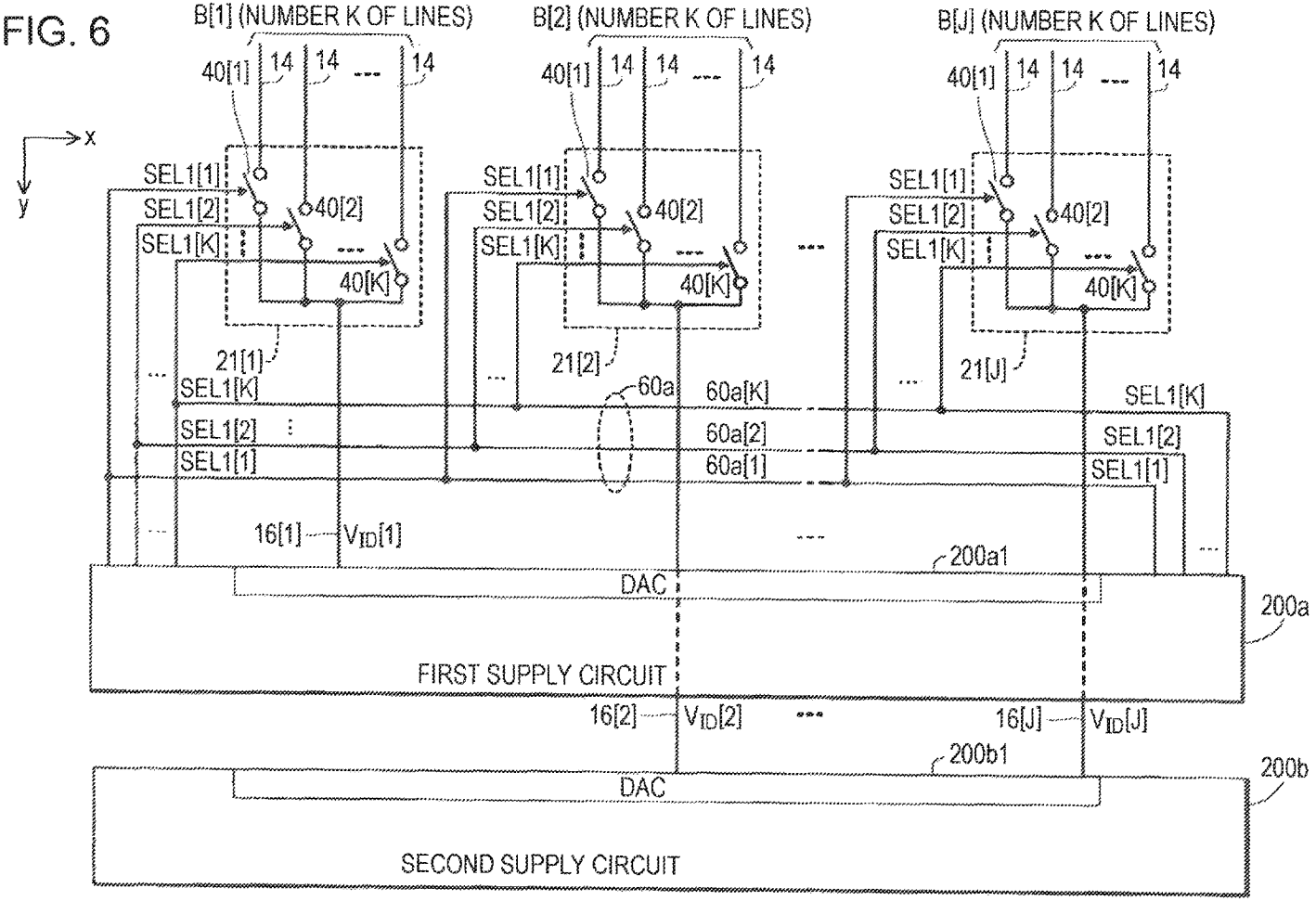
FIG. 6 is a diagram showing an example of distribution circuits, a first supply circuit, and a second supply circuit.

FIG. 6 is a diagram showing an example of the distribution circuits 21[1] to 21[J], the first supply circuit 200*a*, and the second supply circuit 200*b*. A j-th distribution circuit 21[j] includes a number K of switches 40[1] to 40[K] corresponding to a number K of signal lines 14 of a j-th line group B[j]. As the switches 40[1] to 40[K], transistors are used, for example. A k-th (k is in a range of 1 to K) switch 40[k] included in the distribution circuit 21[j] is located between a k-th signal line 14 among the number K of signal lines 14 of the line group B[j] and a j-th data line 16[j] among a number J of data lines 16[1] to 16[J] and controls an electric connection (conduction/non-conduction) between the k-th signal line 14 and the j-th data line 16[j].

Odd-numbered distribution circuits 21[odd] are connected to the first supply circuit 200*a* via odd-numbered data lines 16[odd] and the first input section 110*a*. The first supply circuit 200*a* outputs the data signals $V_{ID}$[odd] to the distribution circuits 21[odd] via the first input section 110*a* and the data lines 16[odd]. The distribution circuits 21[odd] are connected to the first supply circuit 200*a* via a first selection signal line group 60*a* including a number K of first selection signal lines 60*a*[1] to 60*a*[K] and the first input section 110*a*. The first supply circuit 200*a* outputs a selection signal SEL[k] to the distribution circuits 21[odd] via a k-th first selection signal line 60*a*[k] included in the first selection signal line group 60*a*. The distribution circuits 21[odd] use the selection signals SEL[1] to SEL[K] output from the first supply circuit 200*a* to distribute the data signals $V_{ID}$[odd] to a number K of signal lines 14 belonging to each of the line groups B[odd].

Even-numbered distribution circuits 21[even] are connected to the second supply circuit 200*b* via even-numbered data lines 16[even] and the second input section 110*b*. The second supply circuit 200*b* outputs the data signals $V_{ID}$[even] to the distribution circuits 21[even] via the second input section 110*b* and the data lines 16[even]. The distribution circuits 21[even] are connected to the first supply circuit 200*a* via the first selection signal line group 60*a*. The first supply circuit 200*a* outputs the selection signal SEL[k] to the distribution circuits 21[even] via the k-th first selection signal line 60*a*[k] included in the first selection signal line group 60*a*. The distribution circuits 21[even] use the selection signals SEL[1] to SEL[K] output from the first supply circuit 200*a* to distribute the data signals $V_{ID}$[even] to a number K of signal lines 14 belonging to each of the line groups B[even].

The distribution circuits 21[odd] and the distribution circuits 21[even] are alternately arranged and adjacent to each other. The data signals $V_{ID}$[odd] are supplied to the distribution circuits 21[odd] via the first input section 110*a* and the data lines 16[odd]. The data signals $V_{ID}$[even] are supplied to the distribution circuits 21[even] via the second input section 110*b* and the data lines 16[even].

The data lines 16[odd] and the data lines 16[even] are alternately arranged and adjacent to each other. The first input section 110*a* and the second input section 110*b* are arranged adjacent to each other via a gap in the vertical direction (y direction) in the electrooptic panel 100. In this case, a pitch of the data line 16[j] can be smaller than pitches of the data lines 16[odd] and pitches of the data lines 16[even]. In addition, it is easy to alternately arrange pixel groups (multiple first pixels) to which the data signals $V_{ID}$[odd] are supplied and pixel groups (multiple second pixels) to which the data signals $V_{ID}$[even] are supplied. In the case where the pixel groups are arranged in this manner, differences between image qualities of the pixel groups may be not noticeable. In addition, a high-definition image can be displayed without an increase in a dimension of the electrooptic panel 100 in the horizontal direction (x direction).

First Supply Circuit 200*a*

The first supply circuit 200*a* is an example of a first supplying section. The first supply circuit 200*a* includes the DACs 200*a*1 for outputting the data signals $V_{ID}$[odd]. In addition, the first supply circuit 200*a* supplies the selection signals SEL[1] to SEL[K] to the distribution circuits 21[odd] and the distribution circuits 21[even]. The selection signals SEL[1] to SEL[K] are pulse signals that turn on the switches 40[k] included in the distribution circuits 21[j] during predetermined time periods.

As shown in FIG. 2, the first supply circuit 200*a* receives the vertical synchronization signal $V_{SYNC}$, the horizontal synchronization signal $H_{SYNC}$, the digital data signal D–$V_{ID}$[odd], and the selection signals SEL[1] to SEL[K] from the control circuit 500. The first supply circuit 200*a* generates the data signals $V_{ID}$[odd] (first data signals) from the digital data signal D–$V_{ID}$[odd] (third data signal). The first supply circuit 200*a* outputs the data signals $V_{ID}$[odd] from the DACs 200*a*1 to the data lines 16[odd] at time corresponding to the vertical synchronization signal $V_{SYNC}$ and the horizontal synchronization signal $H_{SYNC}$ and outputs the selection signals SEL[1] to SEL[K] to the first selection signal lines 60*a*[1] to 60*a*[K]. The distribution circuits 21[odd] receive the selection signals SEL[1] to SEL[K] from the first selection signal lines 60*a*[1] to 60*a*[K] and use the selection signals SEL[1] to SEL[K] to distribute the data signals $V_{ID}$[odd] to the signal lines 14 (first signal lines).

Second Supply Circuit 200*b*

The second supply circuit 200*b* is an example of a second supplying section. The second supply circuit 200*b* includes the DACs 200*b*1 for outputting the data signals $V_{ID}$[even].

As shown in FIG. 2, the second supply circuit 200*b* receives the vertical synchronization signal $V_{SYNC}$, the horizontal synchronization signal $H_{SYNC}$, the digital data signals D–$V_{ID}$[even], and the selection signals SEL[1] to SEL[K] from the control circuit 500. The second supply circuit 200*b* generates the data signals $V_{ID}$[even] (second data signals) from the digital data signal D–$V_{ID}$[even] (fourth data signal). The second supply circuit 200*b* outputs the data signals $V_{ID}$[even] from the DACs 200*b*1 to the data lines 16[even] at time corresponding to the vertical synchronization signal $V_{SYNC}$ and the horizontal synchronization signal $H_{SYNC}$. The distribution circuits 21[even] use the selection signals SEL[1] to SEL[K] received from the first selection signal lines 60*a*[1] to 60*a*[K] to distribute the data signals $V_{ID}$[even] to the signal lines 14 (second signal lines). The second supply circuit 200*b* has an output section for outputting the selection signals SEL[1] to SEL[K], but the output section is based on an open standard.

Control Circuit 500

The control circuit 500 uses various signals including the synchronization signals to control the scan line driving circuit 20, the first supply circuit 200*a*, and the second supply circuit 200*b*. The control circuit 500 is an example of a controller that controls the first supply circuit 200*a* and the second supply circuit 200*b*. An example of functions of the control circuit 500 is described below.

The control circuit 500 outputs the vertical synchronization signal $V_{SYNC}$ shown in FIG. 3 and the horizontal synchronization signal $H_{SYNC}$ shown in FIG. 3 to the scan line driving circuit 20, the first supply circuit 200*a*, and the second supply circuit 200*b*.

The control circuit 500 outputs, to the first supply circuit 200*a*, the digital data signal D–$V_{ID}$[odd] (third data signal) specifying, for each time range, gradations (gradation levels) of multiple pixels $P_{IX}$ (multiple first pixels) corresponding to intersections of the number M of scan lines 12 with the signal lines 14 belonging to the odd-numbered line groups B[odd].

The control circuit 500 outputs, to the first supply circuit 200*a*, the digital data signal D–$V_{ID}$[odd] that causes the polarities of the data signals $V_{ID}$[odd] to be reversed in each of the vertical scan time periods V, as shown in FIG. 3. The data signals $V_{ID}$[odd] include the potentials specified for each time range and corresponding to the gradations specified by the digital data signal D–$V_{ID}$[odd] for each time range.

The control circuit 500 outputs, to the second supply circuit 200*b*, the digital data signal D–$V_{ID}$[even] (fourth data signal) specifying, for each time range, gradations of multiple pixels $P_{IX}$ (multiple second pixels) corresponding to intersections of the number M of scan lines 12 with the signal lines 14 belonging to the even-numbered line groups B[even].

The control circuit 500 outputs, to the second supply circuit 200*b*, the digital data signal D–$V_{ID}$[even] that causes the polarities of the data signals $V_{ID}$[even] to be reversed in each of the vertical scan time periods V, as shown in FIG. 3. The data signals $V_{ID}$[even] include the potentials specified for each time range and corresponding to the gradations specified by the digital data signal D–$V_{ID}$[even] in the tine ranges.

In addition, the control circuit 500 generates a number K of selection signals SEL[1] to SEL[K] corresponding to the number (number K) of signal lines 14 included in each of the line groups B[j]. The control circuit 500 outputs the selection signals SEL[1] to SEL[K] to the first supply circuit 200*a* and the second supply circuit 200*b*. The selection signals SEL[1] to SEL[K] are timing signals that control the distribution of the data signals $V_{ID}$[odd] to the signal lines 14 belonging to the line groups B[odd] and the distribution of the data signals $V_{ID}$[even] to the signal lines 14 belonging to the line groups B[even].

The control circuit 500 uses low voltage differential signaling (LVDS) to output the vertical synchronization signal $V_{SYNC}$, the horizontal synchronization signal $H_{SYNC}$, the digital data signal D–$V_{ID}$[odd], and the selection signals SEL[1] to SEL[K] to the first supply circuit 200*a*, for example. The control circuit 500 may use a different method from LVDS to output the vertical synchronization signal $V_{SYNC}$, the horizontal synchronization signal $H_{SYNC}$, the digital data signal D–$V_{ID}$[odd], and the selection signals SEL[1] to SEL[K] to the first supply circuit 200*a*. In addition, the control circuit 500 uses LVDS to output the vertical synchronization signal $V_{SYNC}$, the horizontal synchronization signal $H_{SYNC}$, the digital data signal D–$V_{ID}$

[even], and the selection signals SEL[1] to SEL[K] to the second supply circuit 200*b*, for example. The control circuit 500 may use a different method from LVDS to output the vertical synchronization signal $V_{SYNC}$, the horizontal synchronization signal $H_{SYNC}$, the digital data signal $D\text{–}V_{ID}$ [even], and the selection signals SEL[1] to SEL[K] to the second supply circuit 200*b*.

Output Variation Corrector 502

The output variation corrector 502 includes the distributing section 502*a*, the storage section 502*b*, and the correcting section 502*c*, as shown in FIG. 2. The distributing section 502*a* divides the image data signal $DI\text{–}V_{ID}$ into the first distribution image data signal $DI\text{–}V_{ID}$[odd] and the second distribution image data signal $DI\text{–}V_{ID}$[even]. The storage section 502*b* includes the storage section 502*b*1 storing first correction amounts and the storage section 502*b*2 storing second correction amounts. The correcting section 502*c* includes the correcting section 502*c*1 and the correction section 502*c*2. The correcting section 502*c*1 corrects the first distribution image data signal $DI\text{–}V_{ID}$[odd] using a first correction amount stored in the storage section 502*c*1 to generate the digital data signal $D\text{–}V_{ID}$[odd]. The correcting section 502*c*2 corrects the second distribution image data signal $DI\text{–}V_{ID}$[even] using a second correction amount stored in the storage section 502*c*2 to generate the digital data signal $D\text{–}V_{ID}$[even].

The first correction amount is used to correct the first distribution image data signal $DI\text{–}V_{ID}$[odd] and generate the digital data signal $D\text{–}V_{ID}$[odd]. The second correction amount is used to correct the second distribution image data signal $DI\text{–}V_{ID}$[even] and generate the digital data signal $D\text{–}V_{ID}$[even]. Specifically, in the first embodiment, the first correction amount is used to generate the digital data signal $D\text{–}V_{ID}$[odd] serving as a source of the data signals $V_{ID}$[odd] to be generated by the first supply circuit 200*a*, while the second correction amount is used to generate the digital data signal $D\text{–}V_{ID}$[even] serving as a source of the data signals $V_{ID}$[even] to be generated by the second supply circuit 200*b*.

By appropriately setting the first correction amount and the second correction amount, a difference corresponding to the individual difference or the like between the first and second supply circuits 200*a* and 200*b* can be added between the digital data signal $D\text{–}V_{ID}$[odd] and the digital data signal $D\text{–}V_{ID}$[even].

Configurations of LUTs

Figure 7:
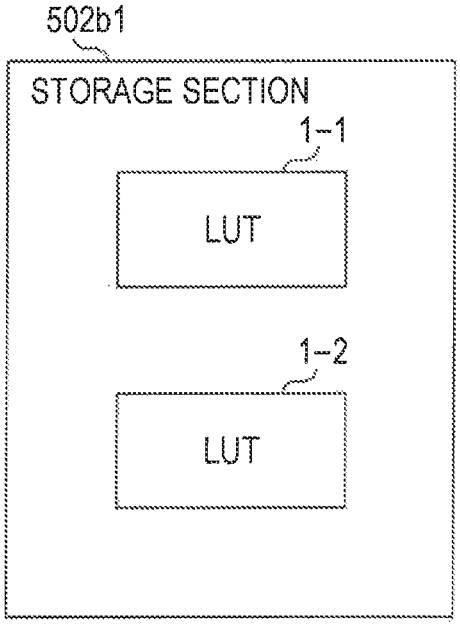
FIG. 7 is a diagram showing an example of a storage section.

As shown in FIG. 7, the first correction amounts are stored as a lookup table (LUT) 1-1 and a LUT 1-2 in the storage section 502*b*1. The LUT 1-1 stores first correction amounts provided for positive polarity and to be used to correct the first distribution image data signal $DI\text{–}V_{ID}$[odd] having a positive polarity. The LUT 1-2 stores first correction amounts provided for negative polarity and to be used to correct the second distribution image data signal $DI\text{–}V_{ID}$ [odd] having a negative polarity. The optimal correction amount varies depending on whether the data signals $V_{ID}$ [odd] output from the first supply circuit 200*a* have a positive polarity or a negative polarity. Thus, the LUT 1-1 storing the first correction amounts for positive polarity and the LUT 1-2 storing the first correction amounts for negative polarity are stored. The first distribution image data signal $DI\text{–}V_{ID}$[odd] with a positive polarity is corrected by the correcting section 502*c*1 using a first correction amount provided for positive polarity and stored in the LUT 1-1. The first distribution image data signal $DI\text{–}V_{ID}$[odd] with a negative polarity is corrected by the correcting section 502*c*1 using a first correction amount provided for negative polarity and stored in the LUT 1-2.

Figure 8:
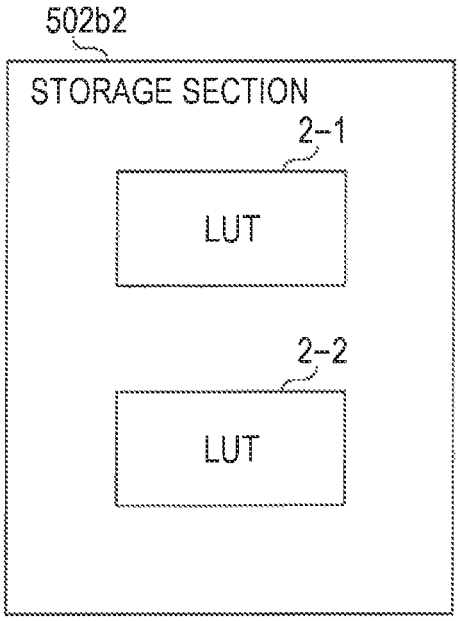
FIG. 8 is a diagram showing an example of a storage section.

As shown in FIG. 8, the second correction amounts are stored as a LUT 2-1 and a LUT 2-2 in the storage section 502*b*2. The LUT 2-1 stores second correction amounts provided for positive polarity and to be used to correct the second distribution image data signal $DI\text{–}V_{ID}$[even] having a positive polarity. The LUT 2-2 stores second correction amounts provided for negative polarity and to be used to correct the second distribution image data signal $DI\text{–}V_{ID}$ [even] having a negative polarity. The optimal correction amount varies depending on whether the data signals $V_{ID}$ [even] output from the second supply circuit 200*b* have a positive polarity or a negative polarity. Thus, the LUT 2-1 storing the second correction amounts for positive polarity and the LUT 2-2 storing the second correction amounts for negative polarity are stored. The second distribution image data signal $DI\text{–}V_{ID}$[even] with a positive polarity is corrected by the correcting section 502*c*2 using a second correction amount provided for positive polarity and stored in the LUT 2-1. The second distribution image data signal $DI\text{–}V_{ID}$[even] with a negative polarity is corrected by the correcting section 502*c*2 using a second correction amount provided for negative polarity and stored in the LUT 2-2.

As described above, since correction amounts to be used vary depending on whether the image data signal $DI\text{–}V_{ID}$ to be corrected has a positive polarity or a negative polarity, the correction can be executed based on the polarity. The first distribution image data signal $DI\text{–}V_{ID}$[odd] and the second distribution image data signal $DI\text{–}V_{ID}$[even] are individually corrected based on the polarity. Thus, a difference related to the correction based on the polarity and corresponding to the difference between the first supply circuit 200*a* and the second supply circuit 200*b* can be added between the digital data signal $DI\text{–}V_{ID}$[odd] and the digital data signal $DI\text{–}V_{ID}$[even].

Thus, a difference, related to the correction based on the polarity, between the digital signals $V_{ID}$[odd] and the digital signals $V_{ID}$[even] can be offset or reduced by the difference between the digital data signal $D\text{–}V_{ID}$[odd] and the digital data signal $D\text{–}V_{ID}$[even] Thus, a reduction, caused by the difference between the data signals $V_{ID}$[odd] and the data signals $V_{ID}$[even], in the image quality can be suppressed.

FIG. 9 is a diagram schematically showing the LUT 1-1 storing the first correction amounts for positive polarity.

The LUT 1-1 is two-dimensionally configured to include gradation levels and the positions of pixels of the pixel section 10 shown in FIG. 2 in the horizontal direction (x direction) and stores the first correction amounts for positive polarity for combinations of the gradation levels and the horizontal pixel positions. Specifically, the first correction amounts are set based on the gradation levels and the horizontal pixel positions. In the first embodiment, the LUT 1-1 stores 25 correction amounts P0 to P24 for combinations of five pixel positions and five gradation levels.

A scan signal that is transferred through a scan line 12 extending in the horizontal direction within the pixel section 10 is reduced in level due to resistance of the scan line 12 as the scan line 12 is farther from the scan line driving circuit 20. Thus, the levels of scan signals in pixels arranged in the horizontal direction vary depending on the positions of the pixels arranged in the horizontal direction. The variation in the levels of the scan signals may cause a reduction in the image quality. The reduction in the image quality may be a problem with the high-definition liquid crystal display device. Since the first correction amounts are set based on the gradation levels and the horizontal pixel positions, the first correction amounts may be set to compensate for differences between the levels of the scan signals at the positions of the multiple pixels (first pixels) driven by the first supply circuit 200*a*. In this case, the first correction amounts may be set based on the gradation levels or may not be set based on the gradation levels. If the first correction amounts are not based on the gradation levels, the LUT 1-1 stores the first correction amounts substantially corresponding to only the positions of pixels arranged in the horizontal direction (x direction) within the pixel section 10.

In addition, the first supply circuit 200*a* includes the DACs 200*a*1 for the multiple data lines 16 arranged side by side in the horizontal direction within the electrooptic panel 100, and the DACs 200*a*1 convert the digital data signal $D-V_{ID}$ to the analog data signals $V_{ID}$ and output the data signals $V_{ID}$. The DACs 200*a*1 correspond to the multiple data lines 16 and are arranged side by side in the x direction and receive power-supply voltages from a common power supply circuit via power supply lines. Since the power supply lines have resistance, the power supply voltages supplied to the DACs 200*a*1 may vary depending on distances (lengths of the power supply lines) between the power supply circuit and the DACs 200*a*1. Since the DACs 200*a*1 are arranged side by side in the x direction, the power supply voltages supplied to the DACs 200*a*1 may vary depending on the positions of the DACs 200*a*1 in the x direction. Output levels of the DACs 200*a*1 may vary due to the variations in the power supply voltages. Since the first correction amounts are set based on the gradation levels and the horizontal pixel positions, the first correction amounts may be set to compensate for differences between the output levels, corresponding to the positions of the DACs 200*a*1, of the DACs 200*a*1. In this case, the first correction amounts may be set based on the gradation levels or may not be set based on the gradation levels.

In addition, input and output characteristics (relationships between the digital data signals $D-V_{ID}$ and the data signals $V_{ID}$) related to the gradation levels may vary for the DACs 200*a*1 due to individual differences between the DACs 200*a*1. Since the first correction amounts are set based on the gradation levels and the horizontal pixel positions, the first correction amounts may be set to compensate for differences between the input and output characteristics, related to the gradation levels, of the DACs 200*a*1. In this case, the first correction amounts may be set based on the horizontal pixel positions or may not be set based on the horizontal pixel positions. If the first correction amounts are not set based on the horizontal pixel positions, the LUT 1-1 stores the first correction amounts substantially corresponding to only the gradation levels.

Since the first correction amounts are set based on the gradation levels and the horizontal pixel positions, the first correction amounts may be set to compensate for the differences between the output levels, corresponding to the positions of the DACs 200*a*1, of the DACs 200*a*1 and compensate for the differences between the input and output characteristics, related to the gradation levels, of the DACs 200*al*.

FIG. 10 is a diagram schematically showing the LUT 1-2 storing the first correction amounts for negative polarity. The LUT 1-2 has the same configuration as the LUT 1-1, except that the LUT 1-2 stores 25 correction amounts M0 to M24 instead of the 25 correction amounts P0 to P24.

The LUT 2-1 storing second correction amounts for positive polarity and the LUT 2-2 storing second correction amounts for negative polarity are two-dimensionally configured to include the gradation levels and the horizontal pixel positions, like the LUTs 1-1 and 1-2, and store the second correction amounts for combinations of the gradation levels and the horizontal pixel positions. Specifically, the second correction amounts are set based on the gradation levels and the horizontal pixel positions. Thus, for example, the second correction amounts may be set to compensate for differences between levels of scan signals at the positions of multiple pixels (second pixels) driven by the second supply circuit 200*b*, differences between output levels, corresponding to the positions of the DACs 200*b*1, of the DACs 200*b*1, and differences between input and output characteristics, related to the gradation levels, of the DACs 200*b*1.

In the first embodiment, the first supply circuit 200*a* corresponding to the LUT 1-1 drives 2048 pixels that are a half of 4096 pixels included in each of the pixel lines and arranged in the horizontal direction within the electrooptic panel 100. In addition, the second supply circuit 200*b* corresponding to the LUT 2-1 drives remaining 2048 pixels among 4096 pixels included in each of the pixel lines and arranged in the horizontal direction within the electrooptic panel 100. In correction arithmetic processing, physically first pixels in the horizontal direction within the pixel section 10 are processed as 0th pixels, and physically 4096th pixels in the horizontal direction within the pixel section 10 are processed as 4095th pixels.

As indicated in the example in which K=4 in FIG. 2, 0th to 3rd pixels, 8th to 11th pixels, . . . , and 4088th to 4091st pixels in the horizontal direction within the electrooptic panel 100 are pixels (first pixels) driven by the first supply circuits 200*a*. The first supply circuit 200*a* executes an internal process on signals and drives 2048 pixels included in each of the pixel lines while treating the 0th to 3rd pixels in the horizontal direction within the electrooptic panel 100 as 0th to 3rd pixels, the 8th to 11th pixels in the horizontal direction within the electrooptic panel 100 as 4th to 7th pixels, . . . , and the 4088th to 4091st pixels in the horizontal direction within the electrooptic panel 100 as 2044th to 2047th pixels. In addition, 4th to 7th pixels, 12th to 15th pixels, . . . , and 4092nd to 4095th pixels in the horizontal direction within the electrooptic panel 100 are pixels (second pixels) driven by the second supply circuit 200*b*. The second supply circuit 200*b* executes an internal process on signals and drives 2048 pixels included in each of the pixel lines while treating the 4th to 7th pixels in the horizontal direction within the electrooptic panel 100 as 0th to 3rd pixels, the 12th to 15th pixels in the horizontal direction within the electrooptic panel 100 as 4th to 7th pixels, . . . , and the 4092nd to 4095th pixels in the horizontal direction within the electrooptic panel 100 as 2044th to 2047th pixels.

In the LUT 1-1, the positions of five pixels, which are the 0th, 511th, 1023rd, 1535th, and 2047th pixels among 2048 pixels arranged in the horizontal direction and to be driven by the first supply circuit 200*a*, are stored. In the first embodiment, the 0th, 511th, 1023rd, 1535th, and 2047th pixels to be driven by the first supply circuit 200*a* correspond to the positions of the 4th, 1019th, 2043rd, 3067th, and 4091st pixels in the horizontal direction within the electrooptic panel 100, respectively. The number of pixel positions (multiple first positions) stored in the LUT 1-1 are not limited to 5 and may be changed.

In the LUT 2-1, the positions of five pixels, which are the 0th, 511th, 1023rd, 1535th, and 2047th pixels among 2048 pixels arranged in the horizontal direction and to be driven by the second supply circuit 200*b*, are stored. In the first embodiment, the 0th, 511th, 1023rd, 1535th, and 2047th pixels to be driven by the second supply circuit 200*b* correspond to the positions of the 4th, 1023rd, 2047th, 3071st, and 4095th pixels in the horizontal direction within the electrooptic panel 100, respectively. The number of pixel positions (multiple second positions) stored in the LUT 2-1 are not limited to 5 and may be changed.

If each of the first distribution image data signal $DI-V_{ID}$[odd] and the second distribution image data signal $DI-V_{ID}$[even] is a 12-bit signal, the number of gradation levels represented by each of the first distribution image data signal $DI-V_{ID}$[odd] and the second distribution image data signal $DI-V_{ID}$[even] is 4096.

The LUT 1-1 stores five gradation levels, a gradation 0, a gradation 1023, a gradation 2047, a gradation 3071, and a gradation 4095. The number of multiple gradation levels (multiple first gradation levels) stored in the LUT 1-1 is not limited to 5 and may be changed. The LUT 1-1 stores the 25 correction amounts P0 to P24 for the combinations of the five pixel positions and the five gradation levels, as shown in FIG. 9.

The LUT 2-1 stores the five gradation levels, the gradation 0, the gradation 1023, the gradation 2047, the gradation 3071, and the gradation 4095. The number of multiple gradation levels (multiple second gradation levels) stored in the LUT 2-1 is not limited to 5 and may be changed. The LUT 2-1 stores the correction amounts for the combinations of the five pixel positions and the five gradation levels.

Correction Process

An example of the correction to be executed by the correcting section 502*c*1 of the control circuit 500 is described below.

Figure 11:
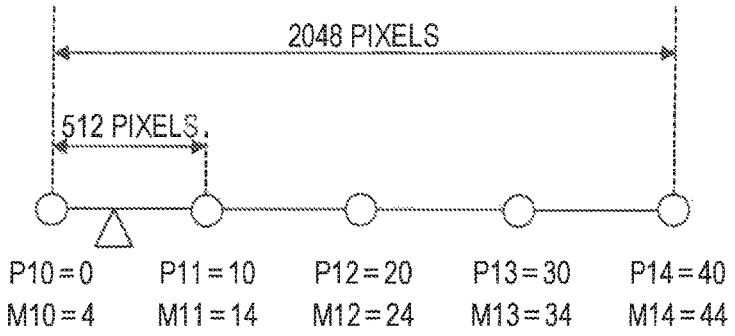
FIG. 11 is a diagram showing an example in which a first distribution image data signal is corrected.
Figure 12:
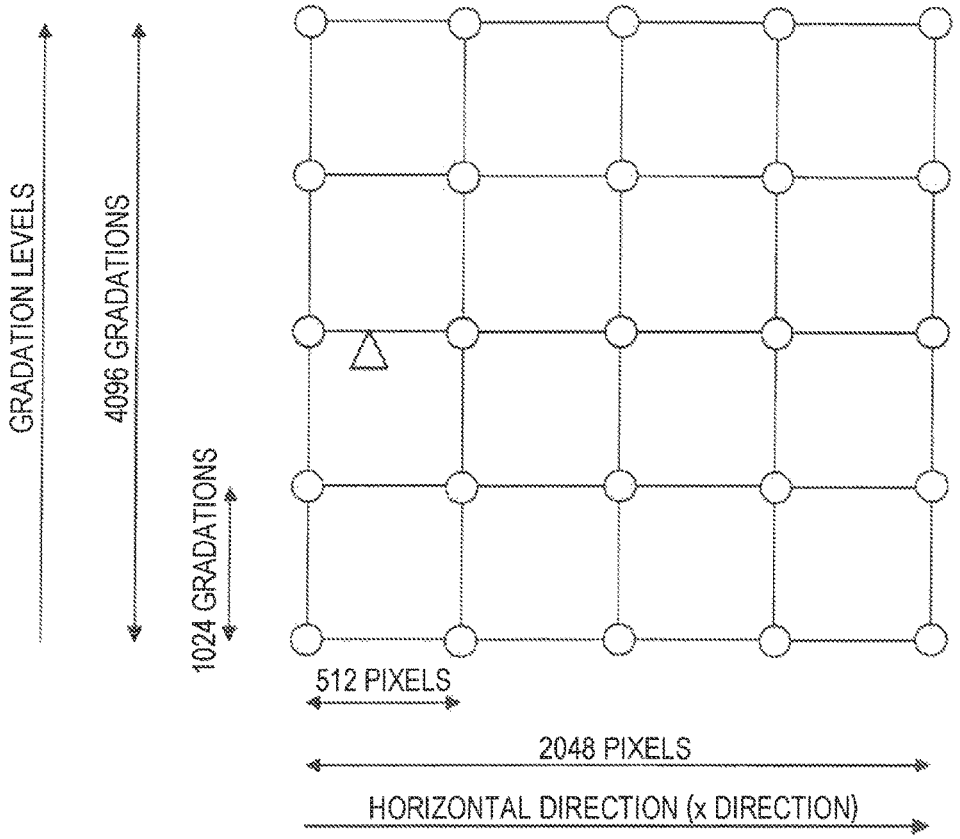
FIG. 12 is a diagram showing a position indicated by a gradation and a pixel among pixels driven by the first supply circuit.

FIG. 11 is a diagram showing an example in which the first distribution image data signal $DI-V_{ID}$[odd] is corrected in order to display the gradation 2047 on the 100th pixel driven by the first supply circuit 200*a*. FIG. 12 is a diagram showing a position indicated by the gradation 2047 and the 100th pixel driven by the first supply circuit 200*a*. In FIGS. 11 and 12, the first distribution image data signal $DI-V_{ID}$[odd] to be corrected corresponds to the position indicated by triangles.

Figure 13:
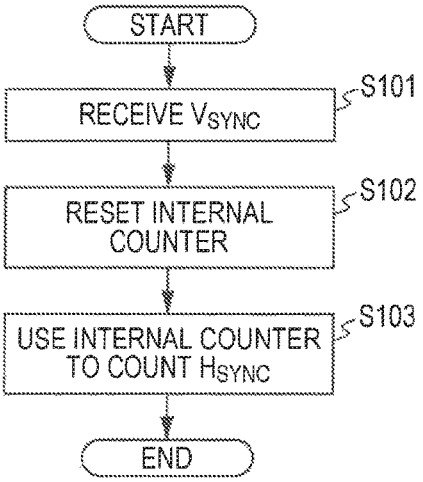
FIG. 13 is a flow diagram describing an operation of counting a horizontal synchronization signal.

FIG. 13 is a flow diagram describing an operation of counting the horizontal synchronization signal $H_{SYNC}$. The horizontal synchronization signal $H_{SYNC}$ is used to identify a horizontal position of a pixel to which the horizontal synchronization signal $H_{SYNC}$ is supplied.

Upon receiving the vertical synchronization signal $V_{SYNC}$ (in step S101), the correcting section 502*c*1 resets an internal counter (not shown) (in step S102). After that, the correcting section 502*c*1 uses the internal counter to count the horizontal synchronization signal $H_{SYNC}$ (in step S103). In step S103, the correcting section 502*c*1 repeats an operation of counting 4 pulses in the horizontal synchronization signal $H_{SYNC}$ and skipping counting of 4 pulses in the horizontal synchronization signal $H_{SYNC}$ after the counting of the 4 pulses. This count value indicates a value obtained by adding "1" to the position (number) of a pixel driven by the first supply circuit 200*a*. The correcting section 502*c*1 repeats the operation shown in FIG. 13 every time the correcting section 502*c*1 receives the vertical synchronization signal $V_{SYNC}$.

Figure 14:
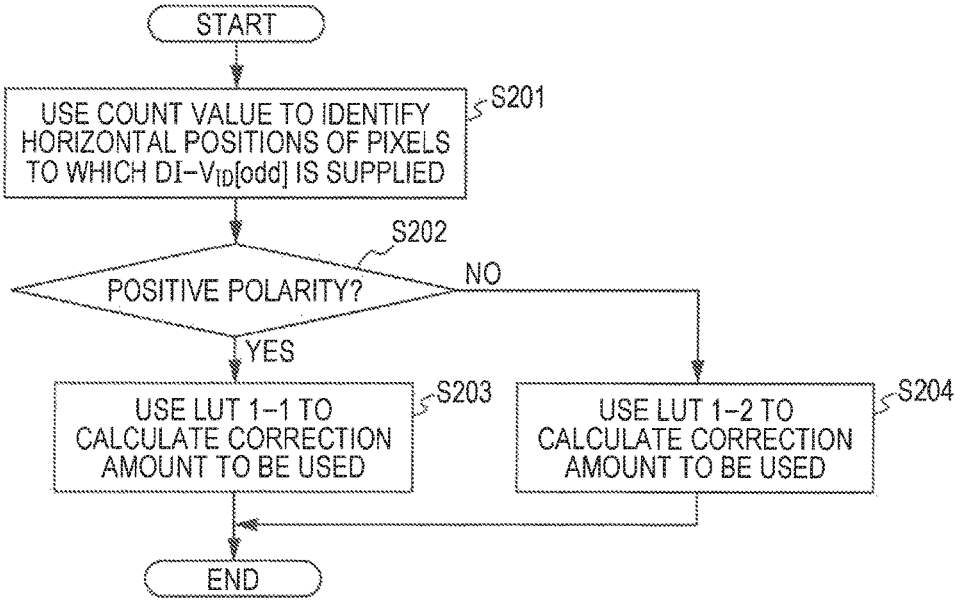
FIG. 14 is a flow diagram describing a correction operation.

FIG. 14 is a flow diagram describing a correction operation executed using the count value of the internal counter. The correcting section 502*c*1 uses the count value of the internal counter to determine a pixel that is among pixels driven by the first supply circuit 200*a* and corresponds to the first distribution image data signal $DI-V_{ID}$[odd] (in step S201).

In the example shown in FIGS. 11 and 12, the correcting section 502*c*1 uses the count value of the internal counter to determine that the first distribution image data signal $DI-V_{ID}$[odd] corresponds to the 100th pixel driven by the first supply circuit 200*a*.

Subsequently, the correcting section 502*c*1 determines whether or not polarity information of the first distribution image data signal $DI-V_{ID}$[odd] indicates a positive polarity (in step S202). If the polarity information indicates the positive polarity (YES in step S202), the correcting section 502*c*1 executes linear interpolation using correction amounts stored in the LUT 1-1 and calculates a correction amount to be used. If the polarity information indicates a negative polarity (NO in step S202), the correcting section 502*c* executes linear interpolation using correction amounts stored in the LUT 1-2 and calculates a correction amount to be used (in step S204).

In the example shown in FIGS. 11 and 12, if the polarity information of the first distribution image data signal $DI-V_{ID}$[odd] indicates the positive polarity, the first distribution image data signal $DI-V_{ID}$[odd] corresponds to the 100th pixel driven by the first supply circuit 200*a*, and the correcting section 502*c*1 executes linear interpolation using the correction amounts P10 and P11 stored in the LUT 1-1 and calculates a correction amount to be used.

On the other hand, if the polarity information of the first distribution image data signal DI−VID[odd] indicates the negative polarity, the correcting section 502*c*1 executes linear interpolation using the correction amounts M10 and M11 stored in the LUT 1-2 and calculates a correction amount to be used.

As shown in FIG. 11, this example assumes that the correction amount P10=0, the correction amount P11=10, the correction amount M10=4, and the correction amount M11=14. The correction amounts are not limited to values shown in FIG. 11 and may be changed.

Whether a correction amount to be used is added to or reduced from the first distribution image data signal $DI-V_{ID}$[odd] can be determined based on whether the polarity information of the first distribution image data signal $DI-V_{ID}$[odd] indicates the positive polarity or the negative polarity.

In this example, if the polarity information indicates the positive polarity, the correcting section 502*c*1 executes the addition. In this example, if the polarity information indicates the negative polarity, the correcting section 502*c*1 executes the reduction.

In the example shown in FIGS. 11 and 12, if the polarity information indicates the positive polarity, the correcting section 502*c*1 executes the following calculation.

$$\text{The correction amount for positive polarity}=\{P11\times 100+P10\times(512-100)\}/512=\{10\times 100+0\times 412\}/512=2.0$$

$$\text{The output for positive polarity}=(D-V_{ID}[\text{odd}])=2047+\text{the correction amount for positive polarity}=2049$$

On the other hand, if the polarity information indicates the negative polarity, the correcting section 502*c*1 executes the following calculation.

$$\text{The correction amount for negative polarity}=\{M11\times 100+M10\times(512-100)\}/512=\{14\times 100+4\times 412\}/512=6.0$$

$$\text{The output for negative polarity}=(D-V_{ID}[\text{odd}])=2047-\text{the correction amount for negative polarity}=2041$$

Figure 15:
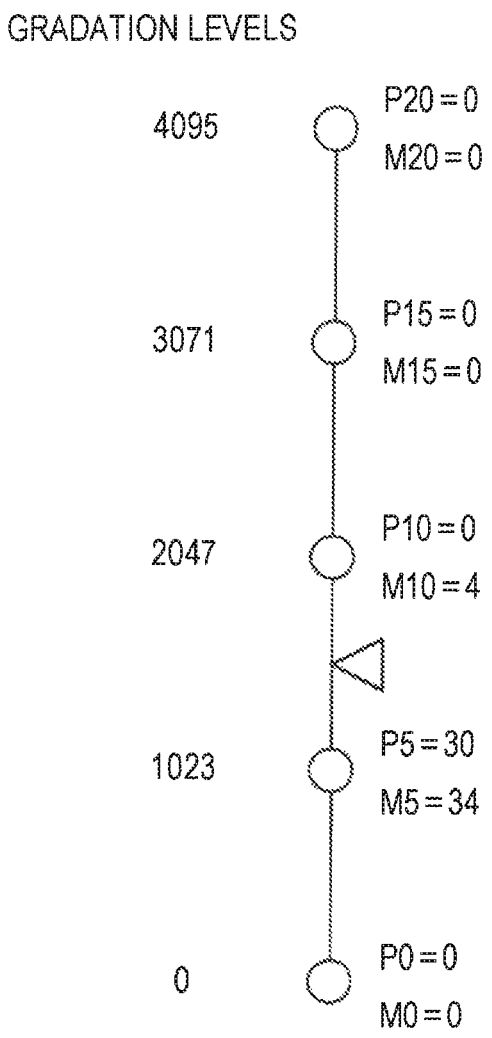
FIG. 15 is a diagram showing an example in which the first distribution image data signal is corrected.
Figure 16:
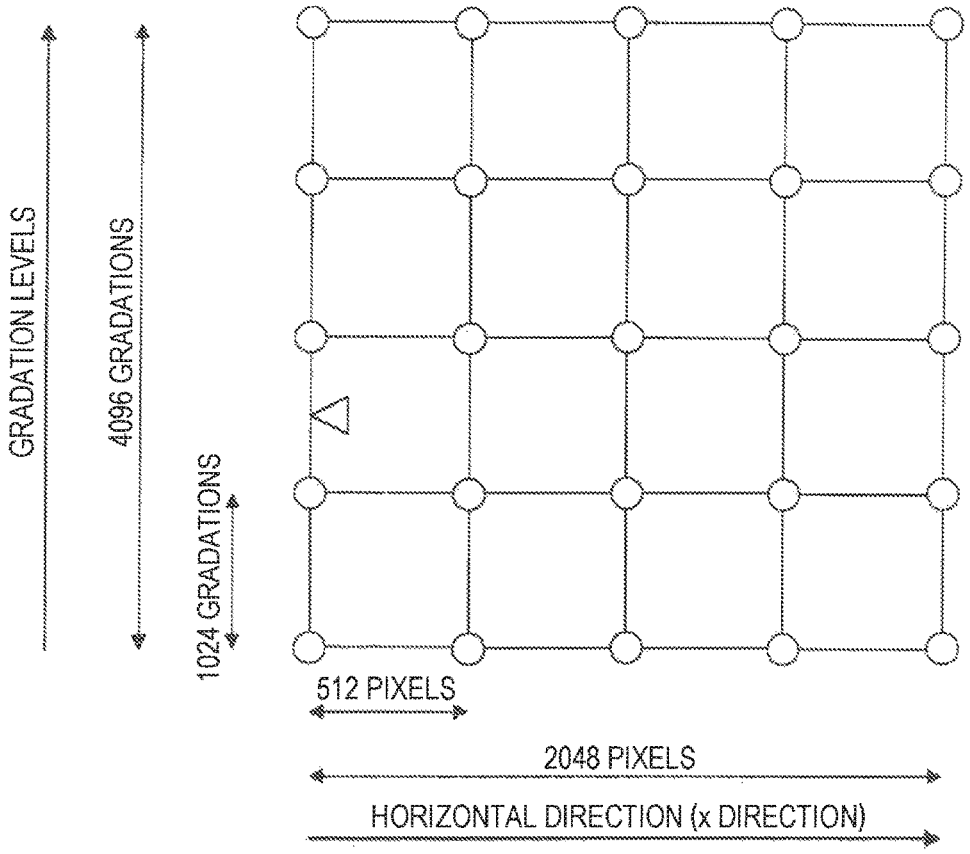
FIG. 16 is a diagram showing a position indicated by a gradation and a pixel among the pixels driven by the first supply circuit.

In addition, FIG. 15 is a diagram showing an example in which the first distribution image data signal $DI-V_{ID}$[odd] is corrected to cause the gradation 1523 to be displayed on the 0th pixel driven by the first supply circuit 200*a*. FIG. 16 is a diagram showing a position indicated by the 0th pixel among the pixels driven by the first supply circuit 200*a* and the gradation 1523 in a two-dimensional plane represented by pixel positions and gradations. In FIGS. 15 and 16, the first distribution image data signal DI–$V_{ID}$[odd] to be corrected corresponds to the position indicated by triangles.

In this case, the correcting section 502*c*1 uses the aforementioned count value to determine that the first distribution image data signal DI–$V_{ID}$[odd] corresponds to the 0th pixel driven by the first supply circuit 200*a*.

If the polarity information of the first distribution image data signal DI–$V_{ID}$[odd] indicates the positive polarity, the correcting section 502*c*1 executes linear interpolation using the correction amounts P5 and P10 stored in the LUT 1-1 and calculates a correction amount to be used.

On the other hand, if the polarity information of the first distribution image data signal DI–$V_{ID}$[odd] indicates the negative polarity, the correcting section 502*c*1 executes linear interpolation using the correction amounts M5 and M10 stored in the LUT 1-2 and calculates a correction amount to be used.

As shown in FIG. 15, this example assumes that the correction amount P5=30, the correction amount P10=0, the correction amount M5=34, and the correction amount M10=4. The correction amounts are not limited to values shown in FIG. 15 and may be changed.

If the polarity information indicates the positive polarity, the correcting section 502*c*1 executes the following calculation.

The correction amount for positive polarity={$P$10×(1523−1023)+$P$5×(2047−1523)}/1024={0×500+30×524}/1024=15

The output for positive polarity=($D$–$V_{ID}$[odd])=1523+the correction amount for positive polarity=1538

On the other hand, if the polarity information indicates the negative polarity, the correcting section 502*c*1 executes the following calculation.

The correction amount for negative polarity={$M$10×(1523−1023)+$M$5×(2047−1523)}/1024={4×500+34×524}/1024=20

The output for negative polarity=($D$–$V_{ID}$[odd])=1523−the correction amount for negative polarity=1503

Although the correction to be executed by the correcting section 502*c*1 is described with reference to FIGS. 11 and 12, the correcting section 502*c*2 calculates, based on the gradation levels and the horizontal pixel positions, a correction amount to be used and uses the calculated correction amount to correct the second distribution image data signal DI–$V_{ID}$[even] in the same manner as the correcting section 502*c*1.

Upon receiving the vertical synchronization signal VSYNC, the correcting section 502*c*2 resets an internal counter (not shown), like the correcting section 502*c*1. After that, however, the correcting section 502*c*2 uses the internal counter to repeatedly execute an operation of skipping counting of 4 pulses in the horizontal synchronization signal $H_{SYNC}$ and counting 4 pulses in the horizontal synchronization signal $H_{SYNC}$ after the skipping of the counting, unlike the correcting section 502*c*1. This count value indicates a value obtained by adding "1" to the position (number) of a pixel driven by the second supply circuit 200*b*. The correcting section 502*c*2 uses this count value to determine the position of the pixel driven by the second supply circuit 200*b*.

Based on whether the polarities of the data signals $V_{ID}$[odd] are positive or negative, the correcting section 502*c* switches whether a correction amount (correction amount based on the first correction amount) to be used is added to or reduced from the first distribution image data signal DI–$V_{ID}$[odd]. In addition, based on whether the polarities of the data signals $V_{ID}$[even] are positive or negative, the correcting section 502*c* switches whether a correction amount (correction amount based on the second correction amount) to be used is added to or reduced from the second distribution image data signal DI–$V_{ID}$[even]. Thus, the addition or reduction of each of the correction amounts to be used can be easily set.

In addition, the correcting section 502*c* corrects the first distribution image data signal DI–$V_{ID}$[odd] using a first correction amount corresponding to the positions, in the horizontal direction (extension direction of the scan lines), of the first pixels to which the data signals $V_{ID}$[odd] are supplied. Then, the correcting section 502*c* corrects the first distribution image data signal DI–$V_{ID}$[even] using a second correction amount corresponding to the positions, in the horizontal direction, of the second pixels to which the data signals $V_{ID}$[even] are supplied. Thus, a difference caused by the individual difference or the like between the first supply circuit 200*a* and the second supply circuit 200*b* and corresponding to the correction related to the pixel positions can be added between the digital data signal D–$V_{ID}$[odd] and the digital data signal D–$V_{ID}$[even]. Thus, a reduction, caused by a variation in the data signals $V_{ID}$[odd] and the data signals $V_{ID}$[even], in the image quality can be suppressed.

In addition, the correcting section 502*c* corrects the first distribution image data signal DI–$V_{ID}$[odd] using a first correction amount corresponding to the level of the first distribution image data signal DI–$V_{ID}$[odd] and corrects the second distribution image data signal DI–$V_{ID}$[even] using a second correction amount corresponding to the level of the second distribution image data signal DI–$V_{ID}$[even]. Thus, a difference corresponding to the correction based on the levels of the data signals can be individually reflected in the digital data signal D–$V_{ID}$[odd] and the digital data signal D–$V_{ID}$[even]. Thus, the reduction, caused by the variation in the data signals $V_{ID}$[odd] and the data signals $V_{ID}$[even], in the image quality can be suppressed.

The storage section 502*b*1 may not store the first correction amounts for the combinations of the gradation levels and the horizontal pixel positions and may store first correction amounts for first horizontal pixel positions, while the storage section 502*b*2 may not store the second correction amounts for the combinations of the gradation levels and the horizontal pixel positions and may store second correction amounts for second horizontal pixel positions.

In this case, if each of the positions of the first pixels to which the data signals $V_{ID}$[odd] are supplied is different from the multiple first horizontal pixel positions, the correcting section 502*c* calculates a correction amount for the first distribution image data signal DI–$V_{ID}$[odd] by executing linear interpolation using first correction amounts and uses the calculated correction amount to correct the first distribution image data signal DI–$V_{ID}$[odd].

In addition, in this case, if each of the positions of the second pixels to which the data signals $V_{ID}$[even] are supplied is different from the multiple second horizontal pixel positions, the correcting section 502*c* calculates a correction amount for the second distribution image data signal DI–$V_{ID}$[even] by executing linear interpolation using second correction amounts and uses the calculated correction amount to correct the second distribution image data signal DI–$V_{ID}$[even].

According to this configuration, even if the number of first correction amounts and the number of second correction amounts are small, a reduction, caused by the variation in the data signals $V_{ID}$[odd] and the data signals $V_{ID}$[even], in the image quality can be suppressed.

In addition, the storage section 502*b*1 may not store the first correction amounts for the combinations of the gradation levels and the horizontal pixel positions and may store first correction amounts for multiple first gradation levels, while the storage section 502*b*2 may not store the second correction amounts for the combinations of the gradation levels and the horizontal pixel positions and may store second correction amounts for multiple second gradation levels.

In this case, if each of the gradation levels of the first distribution image data signal DI–$V_{ID}$[odd] is different from the multiple first gradation levels, the correcting section 502*c* calculates a correction amount for the first distribution image data signal DI–$V_{ID}$[odd] by executing linear interpolation using first correction amounts and uses the calculated correction amount to correct the first distribution image data signal DI–$V_{ID}$[odd].

If each of the gradation levels of the second distribution image data signal DI–$V_{ID}$[even] is different from the multiple second gradation levels, the correcting section 502*c* calculates a correction amount for the second distribution image data signal DI–$V_{ID}$[even] by executing linear interpolation using second correction amounts and uses the calculated correction amount to correct the second distribution image data signal DI–$V_{ID}$[even].

According to this configuration, even if the number of first correction amounts and the number of second correction amounts are small, a reduction, caused by the variation in the data signals $V_{ID}$[odd] and the data signals $V_{ID}$[even], in the image quality can be suppressed.

Second Embodiment

Figure 17:
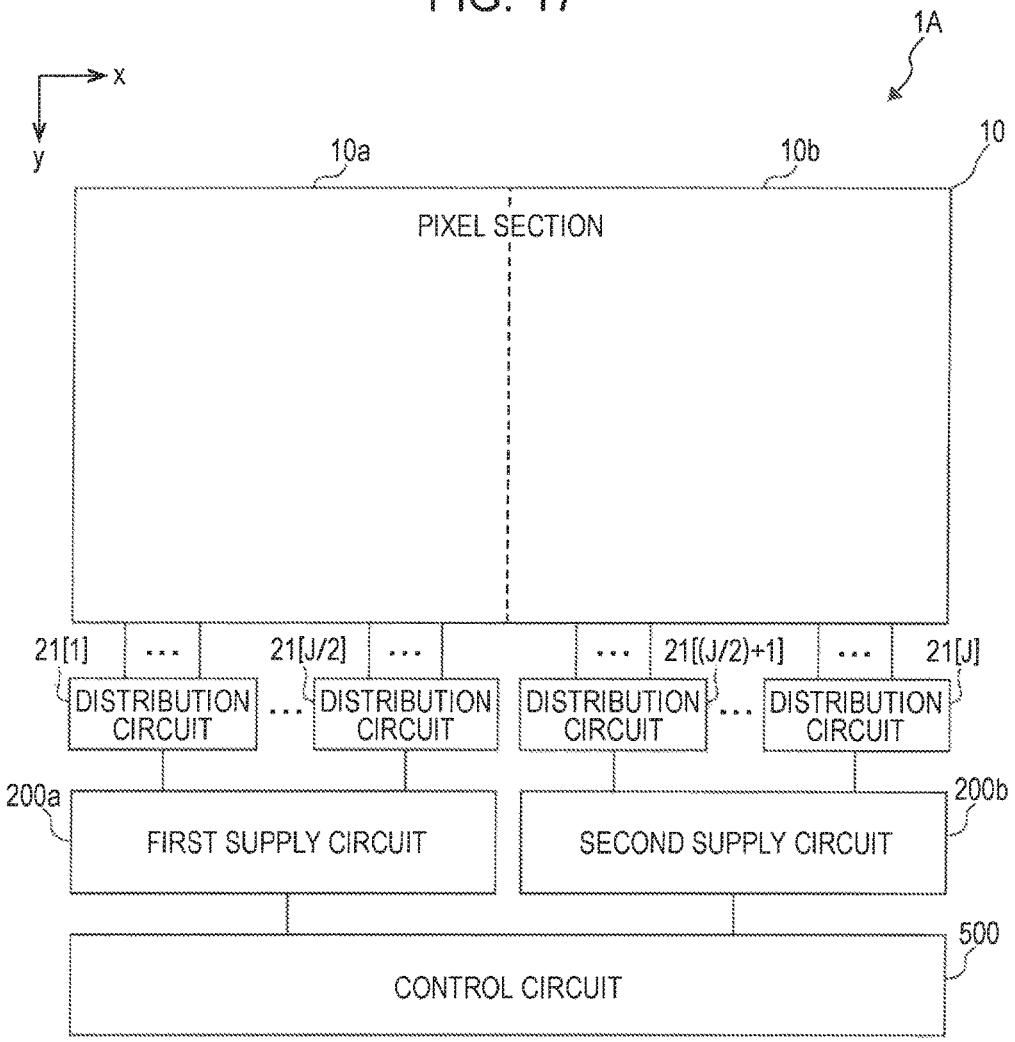
FIG. 17 is a diagram showing an electrooptic device according to a second embodiment of the invention.

In the first embodiment, the line groups B[odd] and the line groups B[even] are alternately arranged. In a second embodiment, as shown in FIG. 17, a pixel section 10 included in an electrooptic device 1A is divided into two sections in the x direction, one (pixel section 10*a*) of the two sections is driven by the first supply circuit 200*a*, and the other (pixel section 10*b*) of the two sections is driven by the second supply circuit 200*b*. Specifically, the first supply circuit 200*a* drives the distribution circuits 21[1] to 21[J/2], and the second supply circuit 200*a* drives the distribution circuits 21[(J/2)+1] to 21[J].

In this case, since the distribution circuits 21[1] to 21[J] are easily classified into a group of the distribution circuits 21[1] to 21[J/2] and a group of the distribution circuits 21[(J/2)+1] to 21[J] based on the positions of the distribution circuits 21[1] to 21[J], wirings between the distribution circuits 21[1] to 21[J], the first supply circuit 200*a*, and the second supply circuit 200*b* can be simplified.

In this case, the 0th to 2047th pixels arranged in the horizontal direction within the electrooptic panel 100 are driven by the first supply circuit 200*a*, and the 2048th to 4095th pixels arranged in the horizontal direction within the electrooptic panel 100 are driven by the second supply circuit 200*b*. The correcting section 502*c*1 resets the internal counter upon receiving the vertical synchronization signal $V_{SYNC}$. After the resetting, the correcting section 502*c*1 uses the internal counter to repeatedly execute an operation of counting 2048 pulses in the horizontal synchronization signal $H_{SYNC}$ and skipping counting of 2048 pulses in the horizontal synchronization signal $H_{SYNC}$ after the counting of the 2048 pulses. In addition, the correcting section 502*c*1 resets the internal counter upon receiving the vertical synchronization signal $V_{SYNC}$. After the resetting, the correcting section 502*c*1 uses the internal counter to repeatedly execute an operation of skipping counting of 2048 pulses in the horizontal synchronization signal $H_{SYNC}$ and counting 2048 pulses in the horizontal synchronization signal $H_{SYNC}$ after the skipping of the counting of the 2048 pulses.

Modified Examples

The aforementioned embodiments may be variously modified. Specific modified examples are described below. Two or more examples arbitrarily selected from among the modified examples may be combined as long as there is no contradiction in the combinations.

First Modified Example

The electrooptic panel 100 is driven by the two first and second supply circuits 200*a* and 200*b*, but may be driven by three or more supply circuits including the first and second supply circuits 200*a* and 200*b*. In this case, it is preferable that the control circuit 500 individually correct data signals serving as sources of digital data signals to be supplied to the supply circuits and generate the digital data signals to be supplied to the supply circuits.

Second Modified Example

In the electrooptic panel 100, a reduction, caused by the difference between the supply circuits, in the quality of an image represented in blue (B) is low, compared with an image represented in red (R) and an image represented in green (G). Thus, the output variation corrector 502 may not correct a digital data signal related to B. In this case, the configurations of the LUTs 1-1 and 1-2 can be simplified.

Third Modified Example

The second supply circuit 200*b* may stop outputting the selection signals SEL[1] to SEL[K]. For example, the second supply circuit 200*b* may stop outputting the selection signals SEL[1] to SEL[K] based on a stop instruction from the control circuit 500.

Fourth Modified Example

The aforementioned embodiments describe the configuration in which the flexible printed circuit boards 300*a* and 300*b* are attached in such a manner that the flexible printed circuit boards 300*a* and 300*b* overlap each other when viewed from the display direction (z direction) of the electrooptic panel 100, as shown in FIG. 1. The invention, however, is not limited to this configuration. For example, the connection terminal 300*a*1 of the flexible printed circuit board 300*a* and the connection terminal 300*b*1 of the flexible printed circuit board 300*b* may be connected to the electrooptic panel 100 while being arranged side by side in the horizontal direction (x direction) of the electrooptic panel 100. In this case, the flexible printed circuit boards 300*a* and 300*b* are easily attached to the electrooptic panel 100. In this example, however, attachment regions included in the flexible printed circuit boards 300*a* and 300*b* and implemented in the pixel section 10 may be larger, and wirings connecting the pixel section 10 to the attachment regions may be longer, compared with the configuration in which the connection terminals 300*a*1 and 300*b*1 shown in FIG. 1 are arranged in the vertical direction (y direction).

Fifth Modified Example

The control circuit 500 may supply, to the electrooptic panel 100, a digital data signal $D\text{–}RV_{ID}$ for R, a digital data signal $D\text{–}GV_{ID}$ for G, and a digital data signal $D\text{–}BV_{ID}$ for B as digital data signals $D\text{–}V_{ID}$ sequentially (for each time range).

Sixth Modified Example

Liquid crystal display devices are used as the electrooptic devices, but it is sufficient if each of the electrooptic devices includes an electrooptic substance having an optical feature that is changed by electric energy. The electrooptic substance corresponds to liquid crystal, organic electro luminescence (EL), or the like.

Application Example

Figure 18:
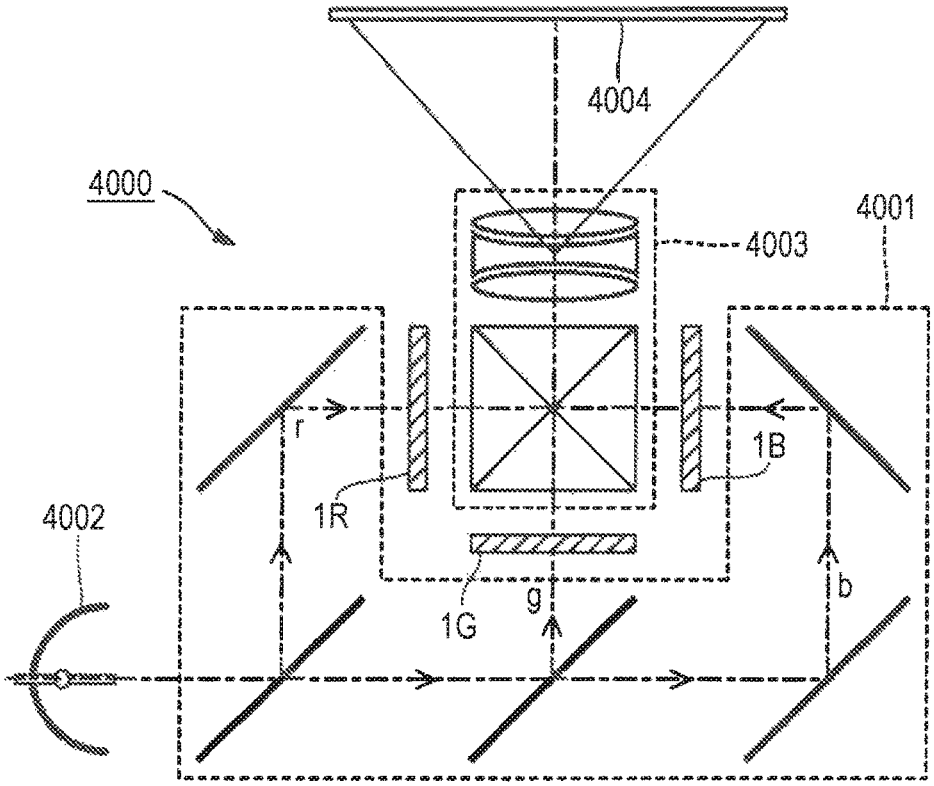
FIG. 18 is a diagram showing a form (projection display device) of an electronic device.

The electrooptic devices exemplified in the embodiments and the modified examples may be used for various electronic devices. FIG. 18 exemplifies a specific form of an electronic device having the electrooptic device according to the first embodiment or the electrooptic device according to the second embodiment.

FIG. 18 is a schematic diagram showing a projection display device (three-plate type projector) 4000 having electrooptic devices. The projection display device 4000 includes the three electrooptic devices 1 (1R, 1G, and 1B) corresponding to different display colors (red, green, and blue). An illumination light system 4001 supplies a red component r included in light emitted by a illumination device (light source) 4002 to the electrooptic device 1R, supplies a green component g included in the light emitted by the illumination device 4002 to the electrooptic device 1G, and supplies a blue component b included in the light emitted by the illumination device 4002 to the electrooptic device 1B. Each of the electrooptic devices 1 functions as an optical modulator (light bulb) for modulating monochromatic light supplied from the illumination light system 4001 based on an image to be displayed. A projection light system 4003 synchronizes light emitted by the electrooptical devices 1 and projects the synthesized light onto a projection surface 4004. The projection display device 4000 that is small in size and achieves high-definition display can be easily achieved by using the aforementioned electrooptical devices 1. In addition, each of the electrooptical devices 1R, 1G, and 1B may include a respective control circuit 500. Alternatively, the electrooptical devices 1R, 1G, and 1B may include the single control circuit 500. If the electrooptical devices 1R, 1G, and 1B include the single control circuit 500, the storage section 502*b* includes LUTs for first and second correction amounts for each of R, G, and B.

Examples of the electronic device having the electrooptic device according to the first embodiment, the electrooptic device according to the second embodiment are the device exemplified in FIG. 18, a portable personal computer, a mobile information terminal (personal digital assistant (PDA)), a digital still camera, a television, a video camera, and a car navigation system. In addition, examples of the electronic device are a display unit (instrument panel) for a car, an electronic organizer, electronic paper, a calculator, a word processor, a workstation, a videophone, a point-of-sale (POS) terminal, a printer, a scanner, a copier, a video player, and a device having a touch panel.

Application No. 2016-214067, filed Nov. 1, 2016 is expressly incorporated by reference herein.

What is claimed is:

1. An electrooptic device comprising:

a plurality of first pixels;

a plurality of second pixels;

a first supplying section that supplies a first data signal to the first pixels and drives the first pixels;

a second supplying section that supplies a second data signal to the second pixels and drives the second pixels;

a controller that supplies a third data signal to the first supplying section and supplies a fourth data signal to the second supplying section; and a storage section that stores a first correction amount and a second correction amount, wherein the first supplying section generates the first data signal based on the third data signal, wherein the second supplying section generates the second data signal based on the fourth data signal, and wherein the controller individually corrects a fifth data signal serving as a source of the third data signal and a sixth data signal serving as a source of the fourth data signal and generates the third data signal and the fourth data signal, wherein the controller uses the first correction amount to correct the fifth data signal and uses the second correction amount to correct the sixth data signal, wherein the first correction amount includes a first correction amount for positive polarity and a first correction amount for negative polarity, and the second correction amount includes a second correction amount for positive polarity and a second correction amount for negative polarity, wherein if the polarity of the first data signal is positive, the controller corrects the fifth data signal using the first correction amount for positive polarity, and if the polarity of the first data signal is negative, the controller corrects the fifth data signal using the first correction amount for negative polarity, and wherein if the polarity of the second data signal is positive, the controller corrects the sixth data signal using the second correction amount for positive polarity, and if the polarity of the second data signal is negative, the controller corrects the sixth data signal using the second correction amount for negative polarity.

2. The electrooptic device according to claim 1, wherein, based on whether the polarity of the first data signal is positive or negative, the controller switches whether a correction amount based on the first correction amount is added to or reduced from the fifth data signal, and wherein, based on whether the polarity of the second data signal is positive or negative, the controller switches whether a correction amount based on the second correction amount is added to or reduced from the sixth data signal.

3. An electronic device comprising the electrooptic device according to claim 2.

4. The electrooptic device according to claim 1, wherein the plurality of first pixels corresponds to intersections of a plurality of scan lines with a plurality of first signal lines, wherein the plurality of second pixels corresponds to intersections of the plurality of scan lines with a plurality of second signal lines, wherein the first correction amount and the second correction amount correspond to positions in an extension direction of the scan lines, wherein the controller corrects the fifth data signal using the first correction amount corresponding to the positions, in the extension direction, of the first pixels to which the first data signal is supplied, and wherein the controller corrects the sixth data signal using the second correction amount corresponding to the positions, in the extension direction, of the second pixels to which the second data signal is supplied.

5. The electrooptic device according to claim 4, wherein the storage section stores a plurality of first positions in the extension direction, first correction amounts for the plurality of first positions, a plurality of second positions in the extension direction, second correction amounts for the plurality of second positions, wherein if each of the positions, in the extension direction, of the first pixels to which the first data signal is supplied is different from the plurality of first positions, the controller calculates a correction amount for the fifth data signal by executing linear interpolation using the first correction amounts and uses the calculated correction amount to correct the fifth data signal, and wherein if each of the positions, in the extension direction, of the second pixels to which the second data signal is supplied is different from the plurality of second positions, the controller calculates a correction amount for the sixth data signal by executing linear interpolation using the second correction amounts and uses the calculated correction amount to correct the sixth data signal.

6. An electronic device comprising the electrooptic device according to claim 5.

7. An electronic device comprising the electrooptic device according to claim 4.

8. The electrooptic device according to claim 1, wherein the first correction amount corresponds to a gradation level of the fifth data signal, wherein the second correction amount corresponds to a gradation level of the sixth data signal, wherein the controller uses the first correction amount to correct the fifth data signal, and wherein the controller uses the second correction amount to correct the sixth data signal.

9. The electrooptic device according to claim 8, wherein the storage section stores a plurality of first gradation levels, first correction amounts for the plurality of first gradation levels, a plurality of second gradation levels, and second correction amounts for the plurality of second gradation levels, wherein if the gradation level of the fifth data signal is different from the plurality of first gradation levels, the controller calculates a correction amount for the fifth data signal by executing linear interpolation using the first correction amounts and uses the calculated correction amount to correct the fifth data signal, and wherein if the gradation level of the sixth data signal is different from the plurality of second gradation levels, the controller calculates a correction amount for the sixth data signal by executing linear interpolation using the second correction amounts and uses the calculated correction amount to correct the sixth data signal.

10. An electronic device comprising the electrooptic device according to claim 8.

11. An electronic device comprising the electrooptic device according to claim 9.

12. An electronic device comprising the electrooptic device according to claim 1.

13. A method of driving an electrooptic device in which a first supplying section supplies a first data signal to a plurality of first pixels and drives the plurality of first pixels and a second supplying section supplies a second data signal to a plurality of second pixels and drives the plurality of second pixels, and a storing section stores a first correction amount and a second correction amount, comprising:

causing a controller to individually correct a fifth data signal serving as a source of a third data signal and a sixth data signal serving as a source of a fourth data signal and generate the third data signal and the fourth data signal;

causing the first supplying section to generate the first data signal based on the third data signal;

causing the second supplying section to generate the second data signal based on the fourth data signal;

causing the controller to use the first correction amount to correct the fifth data signal and to use the second correction amount to correct the sixth data signal, wherein the first correction amount includes a first correction amount for positive polarity and a first correction amount for negative polarity, and the second correction amount includes a second correction amount for positive polarity and a second correction amount for negative polarity, wherein if the polarity of the first data signal is positive, the controller is caused to correct the fifth data signal using the first correction amount for positive polarity, and if the polarity of the first data signal is negative, the controller is caused to correct the fifth data signal using the first correction amount for negative polarity, and wherein if the polarity of the second data signal is positive, the controller is caused to correct the sixth data signal using the second correction amount for positive polarity, and if the polarity of the second data signal is negative, the controller is caused to correct the sixth data signal using the second correction amount for negative polarity.

* * * * *